US010036231B2

(12) United States Patent
Murdoch

(10) Patent No.: US 10,036,231 B2
(45) Date of Patent: Jul. 31, 2018

(54) FLOW CONTROL ASSEMBLY

(71) Applicant: Petrowell Limited, Aberdeen, Aberdeenshire (AE)

(72) Inventor: Euan Murdoch, Aberdeenshire (GB)

(73) Assignees: YULONG COMPUTER TELECOMMUNICATION TECHNOLOGIES (SHENZHEN) CO., LTD., Shenzhen, Guangdong (CN); DONGGUAN YULONG TELECOMMUNICATION TECH CO., LTD., Dongguan, Guangdong (CN)

( * ) Notice: Subject to any disclaimer, the term of this patent is extended or adjusted under 35 U.S.C. 154(b) by 363 days.

(21) Appl. No.: 14/435,982

(22) PCT Filed: Oct. 10, 2013

(86) PCT No.: PCT/GB2013/052638

§ 371 (c)(1),
(2) Date: Apr. 15, 2015

(87) PCT Pub. No.: WO2014/060722

PCT Pub. Date: Apr. 24, 2014

(65) Prior Publication Data

US 2015/0252652 A1 Sep. 10, 2015

(30) Foreign Application Priority Data

Oct. 16, 2012 (GB) ..... 1218568.2
Sep. 10, 2013 (GB) ..... 1316066.8

(51) Int. Cl.
*E21B 34/16* (2006.01)
*E21B 34/08* (2006.01)
(Continued)

(52) U.S. Cl.
CPC ..... *E21B 34/16* (2013.01); *E21B 34/06* (2013.01); *E21B 34/08* (2013.01); *E21B 34/102* (2013.01);
(Continued)

(58) Field of Classification Search
CPC ..... E21B 34/102; E21B 34/10; E21B 34/08; E21B 43/26; E21B 23/006; E21B 23/04
See application file for complete search history.

(56) References Cited

U.S. PATENT DOCUMENTS 4,796,699 A 1/1989 Upchurch
4,896,722 A * 1/1990 Upchurch ..... E21B 23/04 166/250.15

(Continued)

FOREIGN PATENT DOCUMENTS

CA 2808468 A1 9/2013
EP 2636844 A2 9/2013

(Continued)

OTHER PUBLICATIONS

International Search Report and Writen Opinion dated Nov. 24, 2014 for Application No. PCT/GB2013/052638.

(Continued)

*Primary Examiner* — Jennifer H Gay
(74) *Attorney, Agent, or Firm* — Patterson & Sheridan, LLP

(57) ABSTRACT

A flow control method and assembly for an oil or gas well comprises generating a pressure signature in the fluid in a bore of the well comprising a minimum rate of change of pressure, and transmitting the pressure signature to a control mechanism to trigger a change in the configuration of a flow control device in the bore in response to the detection of the pressure signature in the fluid. The flow control device can comprise a barrier, such as a flapper, sleeve, valve or similar.

(Continued)

The pressure signature is transmitted via fluid flowing in the bore, typically being injected into the well, optionally during or before frac operations, via fluid being used for the frac operations. The control mechanism typically includes an RFID reader to receive RF signals from tags deployed in the fluid flowing in the bore.

40 Claims, 23 Drawing Sheets

(51) Int. Cl.

| | |
|---|---|
| ***E21B 34/10*** | (2006.01) |
| ***E21B 43/26*** | (2006.01) |
| ***E21B 34/06*** | (2006.01) |
| ***E21B 47/06*** | (2012.01) |
| ***E21B 47/12*** | (2012.01) |
| *E21B 34/00* | (2006.01) |

(52) U.S. Cl.
CPC ..... *E21B 43/26* (2013.01); *E21B 47/06* (2013.01); *E21B 47/12* (2013.01); *E21B 2034/005* (2013.01); *E21B 2034/007* (2013.01)

(56) References Cited

U.S. PATENT DOCUMENTS

| | | | | |
|---|---|---|---|---|
| 5,273,112 | A | 12/1993 | Schultz | |
| 5,318,137 | A | 6/1994 | Johnson et al. | |
| 5,579,283 | A | 11/1996 | Owens et al. | |
| 5,803,167 | A | 9/1998 | Bussear et al. | |
| 6,125,930 | A | 10/2000 | Moyes | |
| 6,384,738 | B1 | 5/2002 | Carstensen et al. | |
| 8,169,854 | B2 * | 5/2012 | Godager | E21B 47/182 340/854.3 |
| 9,416,643 | B2 * | 8/2016 | Purkis | E21B 43/26 |
| 2004/0226721 | A1 * | 11/2004 | Feluch | E21B 34/101 166/332.4 |
| 2004/0231852 | A1 | 11/2004 | Anyan et al. | |
| 2005/0090985 | A1 | 4/2005 | Goodman | |
| 2005/0092488 | A1 | 5/2005 | Rodet et al. | |
| 2007/0056745 | A1 * | 3/2007 | Contant | E21B 23/04 166/382 |
| 2007/0274844 | A1 | 11/2007 | Jungerink | |
| 2008/0093070 | A1 | 4/2008 | Buyers et al. | |
| 2009/0044937 | A1 * | 2/2009 | Purkis | E21B 47/18 166/72 |
| 2009/0065213 | A1 * | 3/2009 | Burnett | E21B 29/00 166/319 |
| 2009/0218095 | A1 * | 9/2009 | Gordon | E21B 33/1294 166/250.01 |
| 2009/0218104 | A1 * | 9/2009 | Brown | E21B 34/066 166/373 |
| 2010/0071896 | A1 * | 3/2010 | Christie | E21B 34/08 166/250.01 |
| 2011/0186303 | A1 * | 8/2011 | Scott | E21B 34/066 166/373 |
| 2011/0284214 | A1 | 11/2011 | Ayoub et al. | |
| 2012/0067594 | A1 * | 3/2012 | Noske | E21B 34/08 166/373 |
| 2014/0083689 | A1 * | 3/2014 | Streich | E21B 34/063 166/250.15 |
| 2014/0102708 | A1 * | 4/2014 | Purkis | E21B 43/26 166/308.1 |
| 2015/0252652 | A1 * | 9/2015 | Murdoch | E21B 34/102 166/250.01 |

FOREIGN PATENT DOCUMENTS

| | | | | |
|---|---|---|---|---|
| GB | 201204100 | * | 4/2012 | E21B 43/26 |
| GB | 2500044 | A | 9/2013 | |
| WO | 2006/051250 | A1 | 5/2006 | |
| WO | 2007/125335 | A1 | 11/2007 | |
| WO | 2009050517 | A2 | 4/2009 | |
| WO | 2012145735 | A1 | 10/2012 | |
| WO | 2013103907 | A1 | 7/2013 | |
| WO | 2014046841 | A2 | 3/2014 | |

OTHER PUBLICATIONS

John Tough et al., "Radio Frequency Identification of Remotely Operated Horizontal Frac", SPE 143940, pp. 1-6.

Texas Instruments "23-mm Glass Encapsulated Transponder Reference Guide," Literature No. SCBU018, Jul. 1996, 22 pages (http://www.ti.com/lit/ug/scbu018/scbu018.pdf).

Adan, lain—"Radio Frequency Identification (RFID) Leads the Way in the Quest for Intervention Free Upper Completion Installation," SPE 166182, pp. 1-9, prepared for presentation at the SPE Annual Technical Conference and Exhibition held in New Orleans, Louisiana, Sep. 30-Oct. 2, 2013.

Hopmann, Mark et al.—"Pulse Communication Technology Enables Remote Actuation and Manipulation of Downhole Completion Equipment in Extended Reach and Deepwater Applications," SPE 36622, pp. 503-511, prepared for presentation at the 1996 SPE Annual Technical Conference and Exhibition held in Denver, Colorado, Oct. 6-9, 1996.

Jones, Richard et al.—"A Systematic Approach to the Integration of Upper and Lower Completions: A Strategy for Deep Gas Applications," SPE 131774, pp. 1-8, prepared for presentation at the SPE Deep Gas Conference and Exhibition held in Manama, Bahrain, Jan. 24-26, 2010.

Simonds, Randy et al.—"State-of-the-Art Interventionless Completion Technology Provides Key to Greater Cost Reduction and Completion Efficiency," SPE 63006, pp. 1-16, prepared for presentation at the 2000 SPE Annual Technical Conference and Exhibition held in Dallas, Texas Oct. 1-4, 2000.

Vella et al.—"The Nuts and Bolts of Well Testing," Oilfield Review, Apr. 1992, pp. 14-27.

Yuan, Feng et al.—"A New Intervention-less Completion System Using Radio Frequency Identification (RFID) Techniques," SPE 167480, pp. 1-9, prepared for presentatoin at the SPE Middle East Intelligent Energy Conference and Exhibition held in Dubai, UAE, Oct. 28-30, 2013.

United Kingdom Combined Search and Examination Report dated Apr. 8, 2014, for Application No. GB1317919.7.

EPO Communication under Rules 161(1) and 162 EPC dated Jul. 31, 2015, for Application No. 13811598.5.

Australian Examination Report dated Sep. 26, 2016, for Application No. 2013333712.

GCC Examination Report dated Nov. 21, 2016, for Application No. GC 2013-25588.

Singapore Supplementary Examination Report dated Sep. 6, 2017, for Application No. 11201502694P.

Schlumberger Testing Services—"IRIS Dual-Valve Intelligent Remote Implementation System," 7 pages.

Schlumberger—"Intelligent Remote Implementation System for Well Testing," Apr. 17, 1991, 21 pages.

EPO Notice of Opposition dated Mar. 12, 2018, in European Application No. 13811598.5.

* cited by examiner

FIG. 24(a)

Key:
HIB-Hibernation
WPP-Waiting on pressure pulses
WRT-Waiting on RFID tags
Open (del)-Open on a delay AS-ARID-Sleeve
AV-Autostim-Flapper

| Step | Event | Action | AS9 | AV9 | AS8 | AV8 | AS7 | AV7 | AS6 | AV6 | AS5 | AV5 | AS4 | AV4 | AS3 | AV3 | AS2 | AV2 | AS1 |
|---|---|---|---|---|---|---|---|---|---|---|---|---|---|---|---|---|---|---|---|
| | | | | | | | | | Sleeve 6 | Flapper 6 | Sleeve 5 | Flapper 5 | Sleeve 4 | Flapper 4 | Sleeve 3 | Flapper 3 | Sleeve 2 | Flapper 2 | Sleeve 1 |
| 0 | Running completion | - | HIB | HIB | HIB | HIB | HIB | HIB | HIB | HIB | HIB | HIB | HIB | HIB | HIB | HIB | WPP (3 MIN) | WPP (3 MIN) | WPP (3 MIN) |
| 1 | Open sleeve 1 | 3 MIN PP | HIB | HIB | HIB | HIB | HIB | HIB | HIB | HIB | HIB | HIB | HIB | HIB | HIB | HIB | WRT | WRT | Open |
| 2 | Pump tag | RT2 | HIB | HIB | HIB | HIB | HIB | HIB | HIB | HIB | HIB | HIB | HIB | HIB | HIB | HIB | WPP (3 MIN) | Close/ WPP | Open |
| 3 | Open sleeve 2 | 3 MIN PP | HIB | HIB | HIB | HIB | HIB | HIB | HIB | HIB | HIB | HIB | HIB | HIB | HIB | HIB | Open | Close/ WPP | Open |
| 4 | Del opening flapper 2 | ACTI FRAC | HIB | HIB | HIB | HIB | HIB | HIB | HIB | HIB | HIB | HIB | HIB | HIB | HIB | HIB | Open | Open (del) | Open |
| | Flow well 6 months | - | HIB | HIB | HIB | HIB | HIB | HIB | HIB | HIB | HIB | HIB | HIB | HIB | HIB | HIB | Open | Open (del) | Open |
| | 255 days | - | WPP (7 MIN) | WPP (7 MIN) | WPP (5 MIN) | WPP (5 MIN) | WPP (5 MIN) | WPP (5 MIN) | WPP (5 MIN) | WPP (3 MIN) | WPP (3 MIN) | WPP (3 MIN) | WPP (3 MIN) | WPP (3 MIN) | WPP (3 MIN) | WPP (ACTI) | Open | Open (del) | Open |
| 5 | Close flapper 3 | ACTI FRAC | WPP (7 MIN) | WPP (7 MIN) | WPP (5 MIN) | WPP (5 MIN) | WPP (5 MIN) | WPP (5 MIN) | WPP (5 MIN) | WPP (3 MIN) | WPP (3 MIN) | WPP (3 MIN) | WPP (3 MIN) | WPP (3 MIN) | WPP (3 MIN) | Close/ WPP | Open | Open (del) | Open |
| 6 | Activate phase 2.1 (open sleeve 1) | 3 MIN PP | WPP (7 MIN) | WPP (7 MIN) | WPP (5 MIN) | WPP (5 MIN) | WPP (5 MIN) | WPP (5 MIN) | WPP (5 MIN) | WRT | WRT | WRT | WRT | WRT | Open | Close/ WPP | Open | Open (del) | Open |
| 7 | Del opening flapper 5 | ACTI FRAC | WPP (7 MIN) | WPP (7 MIN) | WPP (5 MIN) | WPP (5 MIN) | WPP (5 MIN) | WPP (5 MIN) | WPP (5 MIN) | WRT | WRT | WRT | WRT | WRT | Open | Open (del) | Open | Open (del) | Open |
| 8 | Pump tag | RT4 | WPP (7 MIN) | WPP (7 MIN) | WPP (5 MIN) | WPP (5 MIN) | WPP (5 MIN) | WPP (5 MIN) | WPP (5 MIN) | WRT | WRT | WRT | WPP (3 MIN) | Close/ WPP | Open | Open (del) | Open | Open (del) | Open |

| | | | Sleeve 9 | Flapper 9 | Sleeve 8 | Flapper 8 | Sleeve 7 | Flapper 7 | Sleeve 6 | Flapper 6 | Sleeve 5 | Flapper 5 | Sleeve 4 | Flapper 4 | | | | | |
|---|---|---|---|---|---|---|---|---|---|---|---|---|---|---|---|---|---|---|---|
| | Event | Action | AS9 | AV9 | AS8 | AV8 | AS7 | AV7 | AS6 | AV6 | AS5 | AV5 | AS4 | AV4 | AS3 | AV3 | AS2 | AV2 | AS1 |
| 9 | Open sleeve 4 | 3 MIN PP | WPP (7 MIN) | WPP (7 MIN) | WPP (5 MIN) | WPP (5 MIN) | WPP (5 MIN) | WPP (5 MIN) | WPP (5 MIN) | WRT | WRT | WRT | Open | Close/ WPP | Open | Open (del) | Open | Open (del) | Open |
| 10 | Del opening flapper 4 | ACTI FRAC | WPP (7 MIN) | WPP (7 MIN) | WPP (5 MIN) | WPP (5 MIN) | WPP (5 MIN) | WPP (5 MIN) | WPP (5 MIN) | WRT | WRT | WRT | Open | Open (del) | Open | Open (del) | Open | Open (del) | Open |
| 11 | Pump tag | RT5 | WPP (7 MIN) | WPP (7 MIN) | WPP (5 MIN) | WPP (5 MIN) | WPP (5 MIN) | WPP (5 MIN) | WPP (5 MIN) | WRT | WPP (3 MIN) | Close/ WPP | Open | Open (del) | Open | Open (del) | Open | Open (del) | Open |
| 12 | Open sleeve 5 | 3 MIN PP | WPP (7 MIN) | WPP (7 MIN) | WPP (5 MIN) | WPP (5 MIN) | WPP (5 MIN) | WPP (5 MIN) | WPP (5 MIN) | WRT | Open | Close/ WPP | Open | Open (del) | Open | Open (del) | Open | Open (del) | Open |
| 13 | Del opening flapper 5 | ACTI FRAC | WPP (7 MIN) | WPP (7 MIN) | WPP (5 MIN) | WPP (5 MIN) | WPP (5 MIN) | WPP (5 MIN) | WPP (5 MIN) | WRT | Open | Open (del) | Open | Open (del) | Open | Open (del) | Open | Open (del) | Open |
| 14 | Pump tag | RT6 | WPP (7 MIN) | WPP (7 MIN) | WPP (5 MIN) | WPP (5 MIN) | WPP (5 MIN) | WPP (5 MIN) | WPP (5 MIN) | Close/ WPP | Open | Open (del) | Open | Open (del) | Open | Open (del) | Open | Open (del) | Open |
| 15 | Activate phase 2.2 (open sleeve 6) | 5 MIN PP | WPP (7 MIN) | WPP (7 MIN) | WPP (5 MIN) | WRT | WRT | WRT | Open | Close/ WPP | Open | Open (del) | Open | Open (del) | Open | Open (del) | Open | Open (del) | Open |
| 16 | Del opening flapper 6 | ACTI FRAC | WPP (7 MIN) | WPP (7 MIN) | WPP (7 MIN) | WRT | WRT | WRT | Open | Open (del) | Open | Open (del) | Open | Open (del) | Open | Open (del) | Open | Open (del) | Open |
| 17 | Pump tag | RT7 | WPP (7 MIN) | WPP (7 MIN) | WPP (7 MIN) | WRT | WPP (3 MIN) | Close/ WPP | Open | Open (del) | Open | Open (del) | Open | Open (del) | Open | Open (del) | Open | Open (del) | Open |

FIG. 24(b)

| | | | Sleeve 9 | Flapper 9 | Sleeve 8 | Flapper 8 | | | | | | | | | | | | | |
|---|---|---|---|---|---|---|---|---|---|---|---|---|---|---|---|---|---|---|---|
| | Event | Action | AS9 | AV9 | AS8 | AV8 | AS7 | AV7 | AS6 | AV6 | AS5 | AV5 | AS4 | AV4 | AS3 | AV3 | AS2 | AV2 | AS1 |
| 18 | Open sleeve 7 | 3 MIN PP | WPP (7 MIN) | WPP (7 MIN) | WPP (7 MIN) | WRT | Open | Close/ WPP | Open | Open (del) | Open | Open (del) | Open | Open (del) | Open | Open (del) | Open | Open (del) | Open |
| 19 | Del opening flapper 7 | ACTI FRAC | WPP (7 MIN) | WPP (7 MIN) | WPP (7 MIN) | WRT | Open | Open (del) | Open | Open (del) | Open | Open (del) | Open | Open (del) | Open | Open (del) | Open | Open (del) | Open |
| 20 | Pump tag | RT8 | WPP (7 MIN) | WPP (7 MIN) | WPP (7 MIN) | Close/ WPP | Open | Open (del) | Open | Open (del) | Open | Open (del) | Open | Open (del) | Open | Open (del) | Open | Open (del) | Open |
| 21 | Activate phase 2.3 (open sleeve 8) | 7 MIN PP | WRT | WRT | Open | Close/ WPP | Open | Open (del) | Open | Open (del) | Open | Open (del) | Open | Open (del) | Open | Open (del) | Open | Open (del) | Open |
| 22 | Del opening flapper 8 | ACTI FRAC | WRT | WRT | Open | Open (del) | Open | Open (del) | Open | Open (del) | Open | Open (del) | Open | Open (del) | Open | Open (del) | Open | Open (del) | Open |
| 23 | Pump tag | RT9 | WPP (3 MIN) | Close/ WPP | Open | Open (del) | Open | Open (del) | Open | Open (del) | Open | Open (del) | Open | Open (del) | Open | Open (del) | Open | Open (del) | Open |
| 24 | Open sleeve 9 | 3 MIN PP | Open | Close/ WPP | Open | Open (del) | Open | Open (del) | Open | Open (del) | Open | Close/ WPP | Open | Open (del) | Open | Open (del) | Open | Open (del) | Open |
| 25 | Del opening flapper 9 | ACTI FRAC | Open | Open (del) | Open | Open (del) | Open | Open (del) | Open | Open (del) | Open | Open (del) | Open | Open (del) | Open | Open (del) | Open | Open (del) | Open |

FIG. 24(c)

FLOW CONTROL ASSEMBLY

BACKGROUND OF THE INVENTION

Field of Invention

The present invention relates to a flow control assembly. The invention also relates in certain aspects to a method of controlling flow, especially in the wellbore of an oil and gas well. In certain aspects, the invention relates to a method of controlling downhole barriers, typically in the form of flappers or sleeves, to control the flow of fluid in the region of the barriers, typically during injection procedures, where fluids are being injected from the surface, through the bore, and into the well. The invention relates to the use of pressure signatures in the injected fluid, to convey at least a part of a control signal to a downhole valve in the bore of the oil or gas well, so as to change the configuration of the downhole barrier. In certain aspects, the method and system of the invention have particular utility in hydraulic fracturing procedures (known as fracking or frac'ing), where a bore in the well is being used as a conduit for the injection of fluid from surface, through the bore, and into the formation.

Description of the Related Art

Frac'ing and other injection procedures are well known in the operation and exploitation of oil and gas wells. Typically, during frac'ing procedures, the bore (e.g. the wellbore) is provided with a port to allow communication between the inside of the bore and the outside of the bore, for example to allow fluids to flow from inside the bore (e.g. in a string such as a completion string deployed in the borehole) and into the formation. The port is typically in the form of a side vent or perforation in the bore (e.g. the string). A barrier such as a plug is typically set in the bore below the port, and fluid is injected into the bore from the surface, passing through the port, and into the formation. Frac'ing can be used to improve the formation qualities, or to improve the return from the well, for example, by creating new channels in the formation, which can increase the extraction rates and ultimate recovery of hydrocarbons, or by conveying a well stimulant into the formation.

SUMMARY OF THE INVENTION

According to the present invention there is provided a flow control assembly for use in an oil or gas well, comprising:

a bore to convey fluid between the surface of the well and a formation;

a flow control device located in the bore, the flow control device having first and second configurations, to divert fluid in the bore;

a control mechanism configured to detect pressure changes in the fluid in the bore, wherein the control mechanism is programmed to trigger a change in the configuration of the flow control device in response to the detection of a pressure signature in the fluid, and wherein the pressure signature comprises a minimum rate of change of pressure.

The present invention also provides a method of controlling flow in a bore of an oil or gas well, the method comprising:

providing a control mechanism in the bore, configured to detect a pressure signature in a fluid in the bore, and generating a pressure signature in the fluid in the bore comprising a minimum rate of change of pressure, and transmitting the pressure signature to the control mechanism to trigger a change in the configuration of a flow control device in the bore in response to the detection of the pressure signature in the fluid.

Typically the flow control device can adopt more than two different configurations, for example, 3 configurations or more. Typically the flow control device can have an first open configuration, optionally used when initially running into the hole, a second closed configuration, and a third open configuration used when producing hydrocarbons from the well. Optionally the flow control device can be secured (e.g. fixed) in the second closed or third open configurations.

Typically the flow control device can comprise any downhole flow control device, and typically comprises a barrier. Examples of suitable flow control devices include flappers, sleeves, sliding sleeves, valves, and packers. Typically the flow control device diverts or changes the flow of fluid in the well when it changes configuration.

Typically the pressure signature can comprise a minimum pressure change, which can typically have a low threshold but which is sufficient to cause the mechanism to ignore small transient changes in pressure that are not intended to be positive pressure signatures. However, in certain examples of the invention, the absolute threshold value of pressure reached during the pressure change does not affect the signature.

Typically the pressure change can be held for a minimum time period, which also typically has a low threshold, sufficient to cause the mechanism to ignore short-lived transient changes in pressure that are not intended to be positive pressure signatures. However, in certain examples of the invention, the time for which the pressure change is sustained does not affect the signature.

The change in pressure can comprise an increase, and typically this can be sufficient alone to generate a positive signature that triggers the conformational change in the device. Optionally the change in pressure can comprise a decrease in pressure. Optionally the signature can include both at least one pressure increase and at least one pressure decrease, each with a minimum rate of change of pressure, which can be the same or different. Optionally more than one increase and/or decrease can be required for a valid signature. The increase and decrease can typically be sequential, for example, an increase followed by a decrease, or a decrease followed by an increase. In certain circumstances, for example in the event of a pressure signature being delivered in a tight formation, the pressure signature could comprise an increase following an increase, without necessarily any reduction in pressure between the two increases. Optionally the signature can require a minimum interval between the increase and the decrease, or between the decrease and the increase.

The rate of increase or decrease is typically monitored by a pressure gauge, typically on or near to the control mechanism, which typically samples the pressure at regular intervals, typically intervals of a few seconds, e.g. 10 sec, although the sampling interval can change in different examples of the invention, and typically the pressure changes over these intervals are recorded in order to obtain the rate of change of pressure in the fluid. Typically the control mechanism can be programmed to continuously monitor sequential pressure readings at consecutive sequential time intervals, and to assess whether a particular change in pressure meets the required criteria (e.g. the minimum rate of change of pressure) for a valid positive signature.

Typically a number of sequential pressure readings, all meeting the required minimum rate of change of pressure criteria for a positive signal, are required for the recognition of an actual positive signature. The sequential readings can typically be consecutive (occurring in an unbroken sequence).

Typically the signature requires that the positive readings are contiguous (i.e. occurring one after another in the sampling sequence). Optionally the signature requires that the readings are consistent (i.e. all in the same direction), For example, the rate of change is typically sustained over a number of pressure readings before it is recognised as a positive signature. The minimum number of readings to trigger a positive signature is typically at least two, but could be more, e.g. 3, 4, 5, 6 up to 15 or 20 readings.

The interval between pressure readings and the required rate of change in order to constitute a valid positive signature can be varied in different examples of the invention, but in some examples, a valid positive signature can be recognised after two sequential readings are taken that shows the required minimum rate of change between the readings.

Typically a positive signature can require more complex features before being recognised as a signature that triggers the configuration change. Typically, pressure increases can be repeated over a measured time interval before the mechanism recognises the pressure changes as a valid signature. For example, in one aspect of the invention, a valid positive signature constitutes three repeated pressure spikes, each meeting the requirement for minimum rate of change of pressure, and typically being sustained over a number of sequential pressure measurements (for example two or three sequential pressure measurements), and optionally further requiring the repeated spikes to occur within a measured time period. For example in one embodiment, the pressure signature comprises three pressure spikes, with for example, a three minute interval between each spike (typically with a deviation, which may be for example +/−20-30 s). Accordingly, the valid positive signature can be made more specific by these additional features, requiring not only the minimum rate of change, but typically also the required sustain of the rate of change over a minimum number of sampled time intervals, and the repetition of a valid pressure spike within the required period. Thus, in this example, a valid positive signature is only provided by a sequence of pressure changes meeting all of these requirements, and in the event that pressure spikes are generated meeting the requirement of minimum rate and minimum sustain, but not meeting the requirement of repetition within the time period, the mechanism can optionally be programmed to ignore such signals. This is useful, because it permits different examples of the invention to control different tools within the same well, by varying one of the parameters recognised by the mechanism, which increases the specificity of the system.

Typically the pressure signature can trigger activation of the flow control device. In some examples, the pressure signature can trigger de-activation of the flow control device. Optionally the activation signal is different from the de-activation signal. Optionally the pressure signature can cancel an earlier activation pressure signature. Optionally the control mechanism recognises and responds to the cancellation signal only if it is transmitted within a cancellation period following transmission of the activation signal. Typically the cancellation signal differs from the activation signal in the number of cycles transmitted.

The pressure signature is typically transmitted via fluid within the bore. Typically the fluid is moving (e.g. flowing) in the bore during the transmission of the pressure signature. Typically the pressure signature is transmitted via fluid being injected into the bore, typically when being injected into the well, or when circulating fluid in the bore. The pressure signature can optionally be transmitted during frac operations, via fluid being used for the frac operations.

Typically the pressure signature is a rise above a sampled threshold and is maintained above the threshold for a minimum time period before reducing below the threshold. Typically the pressure is maintained at a constant level (above the threshold) during the minimum time period, but alternatively could vary in amplitude during the time period provided that the pressure did not drop below the threshold during the minimum time period. Optionally other variables can be required by the signature. Requiring at least two variables above a threshold, i.e. pressure and time, in the signature allows significantly more flexibility and accuracy in controlling the downhole devices in the well, and allows the transmission of pressure signals for other downhole devices to be used which incorporate one of the required parameters but not the other, for example the required pressure threshold may be reached in the activation of other tools in the string, but not held for the required time to constitute a valid pressure signature for the flow control device in accordance with the present invention. Hence the activation of other tools elsewhere in the string can continue unhindered without the risk of inadvertent activation or de-activation of the flow control device downhole.

Typically the control mechanism samples the baseline pressure before the pressure signature is applied, and compares the pressure signature to the baseline pressure in order to verify the minimum rate of change of pressure required for a valid pressure signature, and optionally to determine that the pressure threshold required by the pressure signature has been reached, or that it has been maintained above the threshold during the minimum time period. Accordingly in some aspects, the pressure signature is optionally interpreted as a rise in pressure above the measured baseline pressure which is optionally held for the minimum time period before dropping.

Typically the barrier is closed when the baseline pressure is measured.

Typically the assembly has at least one pressure sensor.

Typically the control mechanism has a programmable logic controller. Typically the control mechanism has a memory. Typically the control mechanism has a processor carrying firmware programmed to receive and interpret signals conveyed to the control mechanism and to issue instructions to the flow control device in reaction to the signals.

Typically the control mechanism has a timer device, configured to measure the minimum time period.

Typically a valid pressure signature detected by the control mechanism triggers the barrier to open after a time delay following the detection of the valid pressure signature. Typically the time delay is programmed into the control mechanism, optionally in accordance with the known characteristics of the well, and is typically measured by the timer device. Optionally the delay before configuration change in the flow control device (e.g. time delay between valid pressure signature and barrier opening) is coded into the control mechanism before the control mechanism and flow control device are run into the hole. However in certain aspects of the invention, the time delay and other parameters of the configuration change required in the flow control device as a result of the pressure signature can be conveyed to the control mechanism separately after running into the hole. For example, in some aspects the control mechanism includes an RFID reader and the parameters of the configuration change for the flow control device can be transmitted to the control mechanism in an RFID tag deployed from the surface to flow past the RFID reader in the control mechanism.

Optionally the bore includes a selectively actuable port having an open configuration allowing fluid to pass through the port and thereby to exit the bore; and a closed configuration which denies fluid passage through the port. Typically the string is run into the well with the port closed and the port is then typically opened after the string is in place in the well.

Optionally the selectively actuable port can be controlled by a port pressure signature carried by the fluid in the well. Optionally the port pressure signature can be a sequence of pressure pulses applied to the fluid in the well, and detected at the selectively actuable port. Optionally the pressure pulses controlling the selectively actuable port are received and processed by the control mechanism, but in certain circumstances, the pressure pulses can be received and processed by a control mechanism provided for the selectively actuable port, e.g. in the form of a pressure transducer provided on the port.

Optionally the selectively actuable port is controlled by the control mechanism (typically having its own controller), and is activated to receive and react to the pressure pulses by the control mechanism, so that in the absence of the activation of the port by the control mechanism, it does not react to the pressure pulses in the fluid in the bore.

The control mechanism typically includes a radio frequency identification (RFID) reader adapted to receive radio frequency signals from RFID tags deployed in the bore. A suitable reader and suitable RFID tags for conveying the RF signals to the reader is disclosed in our earlier PCT publication WO2006/051250 which is incorporated herein by reference.

Typically, an RFID tag is deployed in the wellbore, typically by deploying the RFID tag into the fluid flowing in the bore from the surface to the control mechanism, and typically passing the RFID tag through the reader, which typically incorporates a through-bore.

Typically the RFID tag conveys a signal to the RFID reader, which is programmed to activate the control mechanism on receipt of the signal from the tag, and enable the flow control device to respond to the signature in the pressure fluctuations carried by the fluid in the bore, typically from the surface. Typically the control mechanism is only able to receive the signature, and change the configuration of the flow control device, after being activated by the RF signal encoded on the RFID tag.

Typically the RFID reader activates the selectively actuable port to receive and react to the port pressure signature once the RFID tag has conveyed the RF signal to the RFID reader. Typically the selectively actuable port is non-reactive to the port pressure signature until the activation of the port by the control mechanism, e.g. the RFID tag communicating the RF signal to the RFID reader in the control mechanism. Optionally the selectively actuable port and the flow control device are controlled by respective RFID readers forming part of the control mechanism. The respective port and flow control device RFID readers can be configured to react to the same signal, or different signals, or each of the port and the flow control device can be controlled by the same RFID reader, which can optionally send different or the same control instructions to the port and the flow control device respectively.

Typically the wellbore is divided into separate zones, each typically with a respective flow control device, and optionally each with a respective selectively actuable port. Optionally each zone has a respective control mechanism, which can typically be activated (e.g. by an RFID tag dropped from surface) independently of a control mechanism, flow control device and/or port in other zones. Each zone is typically isolated from other zones in the well, e.g. by packers or cup seal devices which occlude or restrict the annulus. Typically each zone can be controlled independently of other zones in the well. Typically each zone can be programmed to receive and react to either the same or a different pressure signature.

Optionally the pressure signature can trigger different responses in different zones, either by carrying different instructions to different zones, or by carrying the same data, which is interpreted differently by different control mechanisms in different zones. Optionally injection procedures carried out in initial zones can yield useful information that is used to vary injection treatments applied to later zones of the well, and might not be known at the time of starting the initial injection procedure on the first zone. For example, the time taken to inject a required fluid treatment such a given amount of proppant may be estimated for the first zone, typically the lowest zone in the well, and the data from the first injection operation into that zone might indicate that a longer injection time might be beneficial in later operations, for example, because of an unexpectedly non-porous formation. Accordingly the later injection procedures might be carried out over a longer injection time period, which can be signalled by using a different signature with a longer "close barrier" delay signal to permit longer injection times through the port, or alternatively the later zones can be programmed to respond to the same pressure signal by the deployment of an RFID tag instructing the zone to close the barrier and open the port for the required longer injection time.

Typically the control mechanism is programmed to close the barrier on receipt of a signal from the RFID tag. Typically the barrier is located below the port in each zone, whereby closing the barrier below the port enhances the ability of the port to react to pressure changes in the fluid in the closed bore, and diverts fluid through the port when the port is opened. Typically once the barrier has been closed, by the action of the control mechanism responding to the RFID signal, the control mechanism activates the selectively actuable port to receive and react to the port pressure signature. The RFID signal typically does not itself open the port, although it could be configured to do so in some cases, but in certain examples it activates the port to receive the port pressure signature, and it is the pressure signature that initiates opening of the port. The port pressure signature typically has different characteristics than the pressure signature that opens the barrier device. Opening the port allows injection of fluid through the bore, which is diverted by the closed barrier device and flows through the open port in the sidewall of the bore, and thus flows into the formation. Injection or frac'ing fluids can then be pumped through the bore at high volumes and high pressures for relatively long periods, into the formation via the bore and the open port, to treat the formation and improve the formation characteristics. The exact nature of fluid injected during the procedure is not important, and many different known frac and injection treatments can be delivered into the formation in this way in different examples of the invention. For example, this step in the procedure permits water injection, stimulant and acid injection etc. to improve the flow of production fluids from the formation into the bore at a later stage of the process.

Transmitting the "open barrier" signal via the pressure profile of the injected fluid means that the "open barrier" signal can be transmitted while the zone is being treated by frac'ing or other injection treatment, so a long signal can be coded in the pressure signature, at high pressures, and for relatively long periods of time enabling a strong signal with a beneficial signal to noise ratio that is easily interpreted by the assembly, but which is transmitted at the same time as the well structure is conducting a different operation (in this case injection, or frac'ing) while the bore is open. This saves time in overall bore operations, as it is not necessary to close the well separately in order to pressure pulse other signals to the tools in the assembly.

Typically the barrier device can comprise a valve such as a flapper valve, ball valve, sliding sleeve valve, or similar.

Thus in certain examples, a possible procedure for injection of fluids into different zones might be as follows (typically in the following sequence, but this is not essential):

1) Circulate RFID tag in well to close barrier in lowermost zone (e.g. zone 1) to be treated;

2) Apply port pressure signature in wellbore fluid to open the selectively actable port (e.g. with closed barrier permitting a closed volume of wellbore fluid for transmission of the port pressure signature);

3) Inject fluid from surface pumps through wellbore, keeping barrier device closed, so that fluid is diverted through the open port, into the formation for frac'ing or other injection treatment in zone 1;

4) Apply pressure signature during fluid injection procedure (minimum rate of increase in pressure, optionally sustained above a minimum threshold, and optionally for a minimum time period) to communicate to barrier device to open after a time delay (Td) following the pressure signature;

5) Continue to inject fluid in frac'ing or injection procedure and curtail injection before pressure signature+Td;

6) Wait until barrier opens after pressure signature+Td (optional);

7) Circulate fluid in well and drop RFID tag to close barrier in next zone (e.g. zone 2 or zone 5, or zone 3, etc.);

8) Repeat process with zone 2 and onwards up wellbore.

Different zones can be selected for separate treatment, and it is not necessary to treat adjacent zones sequentially.

The barrier typically has two open configurations permitting flow, and one closed configuration denying or restricting flow. Optionally the barrier can be moved from its initial open configuration, to its closed configuration, and from there to its second open configuration.

In certain aspects of the invention, fluids are flowed through the selectively actuable port without necessarily being injected into the formation. For example, in certain wellbore clean-up operations, the injected fluid can be flowed from the central bore of an inner string of tubing, through the selectively actuable port located in the inner string, and can then pass into an annular area between the inner string, and an outer string of tubular or liner. The fluid passing through the selectively actuable port can therefore be injected into the annular area typically at high speed and at high volumes, which can be useful for clean-up operations to wash debris etc. that is located in the annulus, back to the surface for recovery from the well.

In a further aspect, the present invention provides a flow control assembly for use in an oil or gas well, comprising:

a bore in the well to convey fluid between the surface of the well and a formation;

a flow control device located in the bore, the flow control device having first and second configurations, to divert fluids in the bore;

a control mechanism configured to detect pressure changes in the fluid conveyed in the bore, and wherein the control mechanism is programmed to trigger a change in the configuration of the flow control device in response to the detection of a pressure signature in the fluid comprising a minimum pressure change which is held for a minimum time period.

In a further aspect, the present invention also provides a method of controlling flow in a bore of an oil or gas well, the method comprising:

providing a control mechanism in the bore, configured to detect a pressure signature in a fluid in the bore, and generating a pressure signature in the fluid in the bore comprising a minimum pressure change which is held for a minimum time period, and transmitting the pressure signature to the control mechanism to trigger a change in the configuration of a flow control device in the bore in response to the detection of the pressure signature in the fluid.

The above optional features of the earlier aspects of the invention can typically also be used with these further aspects of the invention.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention.

Various aspects of the invention will now be described in detail with reference to the accompanying figures. Still other aspects, features, and advantages of the present invention are readily apparent from the entire description thereof, including the figures, which illustrates a number of exemplary aspects and implementations. The invention is also capable of other and different examples and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa.

All numerical values in this disclosure are understood as being modified by "about". All singular forms of elements, or any other components described herein are understood to include plural forms thereof and vice versa. References to directional and positional descriptions such as upper and lower and directions e.g. "up", "down" etc. are to be interpreted by a skilled reader in the context of the examples described and are not to be interpreted as limiting the invention to the literal interpretation of the term, but instead should be as understood by the skilled addressee. In particular, positional references in relation to the well such as "up" will be interpreted to refer to a direction toward the surface, and "down" will be interpreted to refer to a direction away from the surface, whether the well being referred to is a conventional vertical well or a deviated well.

BRIEF DESCRIPTION OF THE DRAWINGS

In the accompanying drawings:

FIG. 24 shows a chart of the activation status of the tools in FIG. 15 in the different stages of activation referred to in FIGS. 16 to 23;

DETAILED DESCRIPTION

Figure 1:
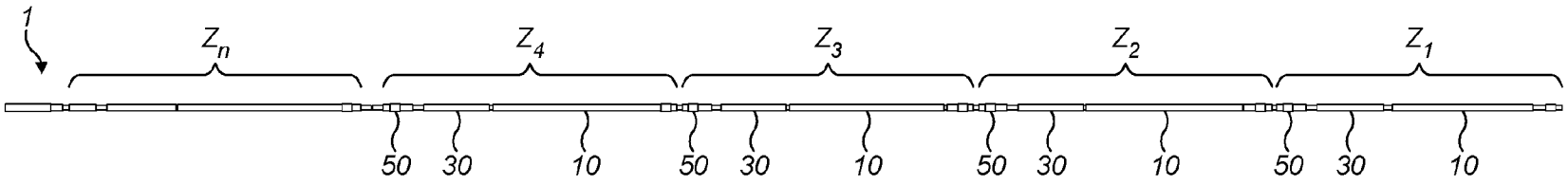
FIG. 1 shows a side view of a tool string having a flow control assembly in accordance with the invention.

Referring now to the drawings, FIG. 1 shows a tool string 1 disposed in a bore of a well (not shown). The tool string 1 extends between different adjacent zones of the well Z1, Z2, Z3 . . . Zn. Optionally each zone of the bore contains a substantially identical set of tools in the string, typically repeated in the same sequence and orientation in each zone, although some zones can incorporate different tools. In particular, each zone typically includes a flow control device in the form of a barrier sub having a barrier device 10 typically in the form of a flapper valve, a control mechanism 20, and a port sub with a selectively actuable port 30 typically in the form of a sliding sleeve. Typically adjacent zones are isolated from one another by a zonal isolation seal, typically in the form of a flip out cup seal 50. As can be seen clearly from FIG. 1, the elements in the string typically repeat in each zone, for as many zones as is required in the well.

Typically, the tool string 1 is run into the well during a completion operation as part of the completion string. Typically the tool string 1 will be run into naked borehole, but in certain examples it could be run inside a liner or casing. Typically the tool string 1 creates an annulus between the tool string 1 and the borehole or the liner surrounding it. In most circumstances, the annulus will be occluded by the zonal isolation seal 50, thereby isolating each zone from adjacent zones. This permits production of fluids from some zones but not others, and is extremely useful when certain zones of the well are producing more water than others, or are producing harmful or corrosive production fluids. In such cases, zones producing undesirable production fluids, or low quantities of hydrocarbons, can be closed off, and production can be increased from the zones that produce the highest ratios of usable production fluids.

Figure 2:
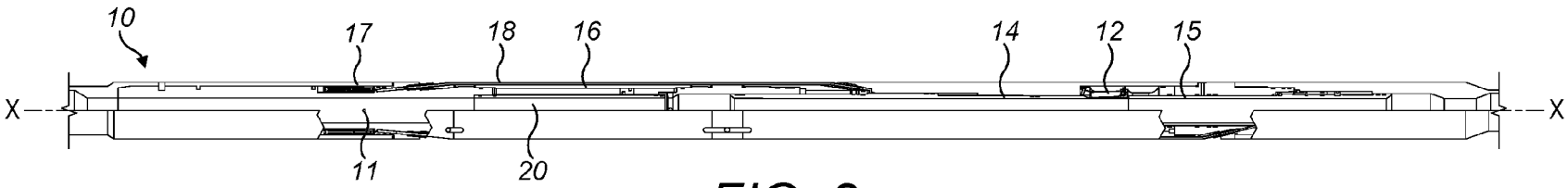
FIG. 2 shows an expanded view of a flow control device in the form of a barrier device forming part of the tool string of FIG. 1.
Figure 3:
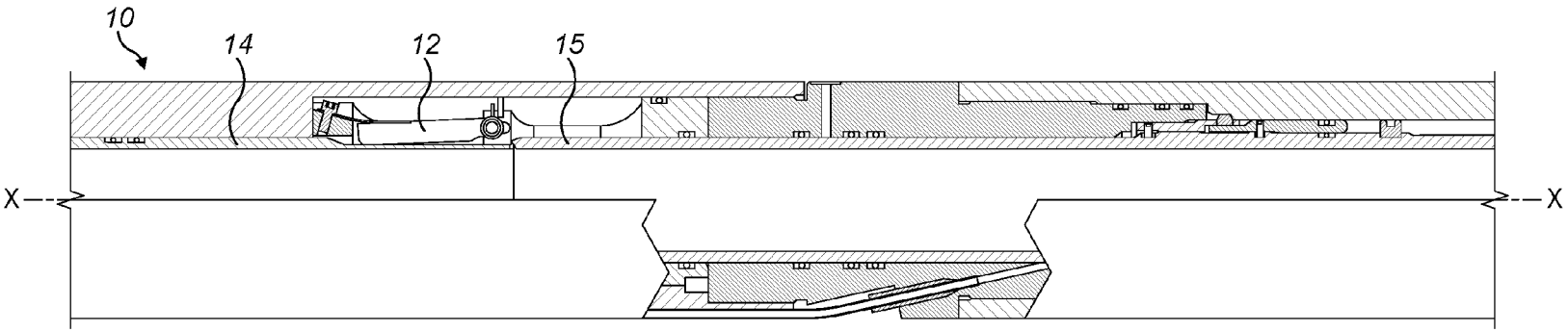
FIG. 3 is an expanded view of a lower portion of the FIG. 2 barrier device, showing a flapper.
Figure 4:
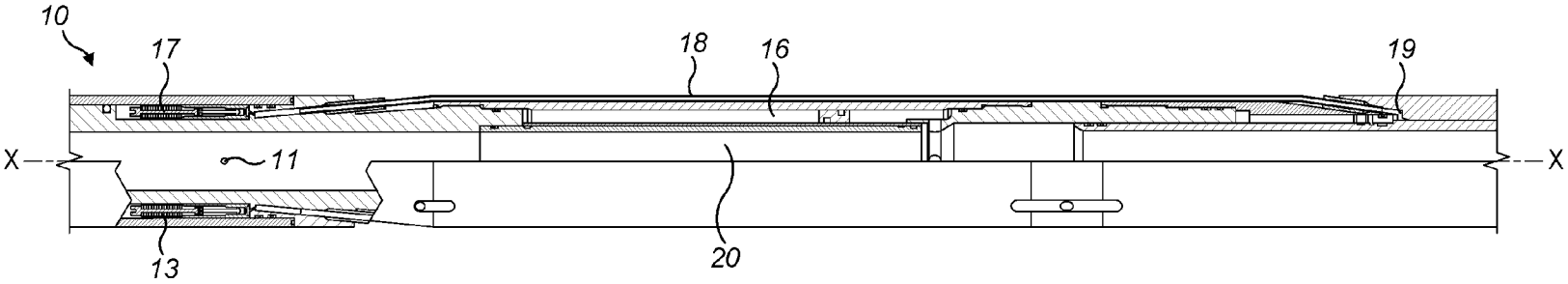
FIG. 4 shows an expanded view of the an upper portion of the FIG. 2 barrier device.

Referring now to FIGS. 2 to 4, the barrier device 10 typically comprises a flapper valve having a flapper 12, which is typically pivotally attached on one side of the axis X of the bore, and which can typically move pivotally through at least 180°, so that it can adopt an open position as shown in FIGS. 2 and 3, where the flapper is essentially parallel to the axis X of the central bore in the tool string, or it can be rotated through 90°, so that the flapper 12 adopts a position perpendicular to the axis X, so that it occludes the central bore of the tool string 1. Typically the flapper 12 can adopt a second open configuration that is at least a 180° rotation from its initial open configuration. One optional design of flapper is our Autostim valve, described in WO2007/125335, which is incorporated herein by reference.

The flapper 12 is typically retained by an upper sleeve 14, and a lower sleeve 15, which slide axially within the bore of the tool string 1 to control and support the flapper 12 in its different open and closed configurations.

The movement of the flapper 12 is controlled by a control mechanism which includes (in this example) an RFID antenna 20 having a through bore that is coaxial with an axis X of the tool string 1, and which is typically located upstream of the flapper 12 in the barrier device 10. The RFID antenna 20 is configured to sense the passage of an RFID tag through the central bore of the antenna 20, and to trigger a switch such as a fuse 17, which connects a fluid conduit 18 to a reservoir 16, and permits the communication of pressure in the central bore of the tool string 1 with an annular chamber 19 formed radially outside a sealed area of the upper sleeve 14. The upper sleeve 14 retains the flapper 12 in the first open configuration shown in FIG. 3. Communication of the pressure into the annular chamber 19 moves the sleeve 14 upwards from the position shown in FIG. 3, so that the lower end of the sleeve 14 clears the flapper 12, allowing the flapper to swing around its pivot point under the force of the fluid in the bore, or under the force of a spring in some cases, and seal against the seat formed by the upper surface of the lower sleeve 15. This effectively closes the bore through the barrier device 10, denying fluid communication past the flapper 12. The sleeve 15 cannot move axially in the bore at this point, so the flapper 12 is held in the closed configuration seated on the sleeve 15, and perpendicular to the axis X through the central bore of the barrier device 10.

Figure 5:
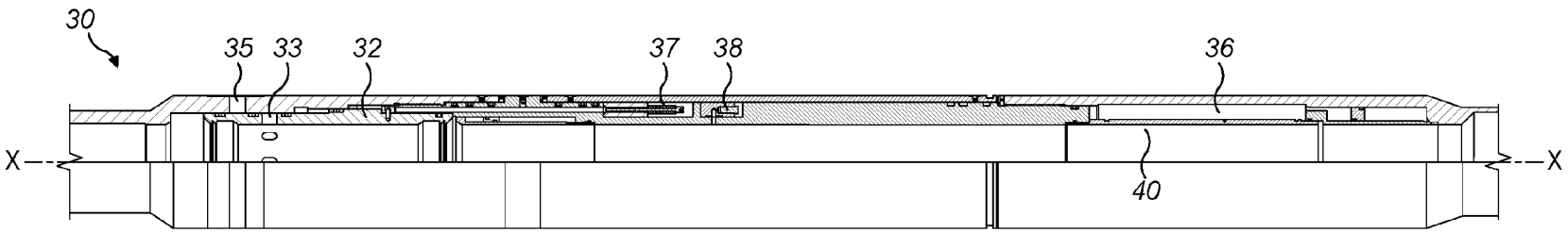
FIG. 5 shows a selectively actuable port forming part of the FIG. 1 tool string.
Figure 6:
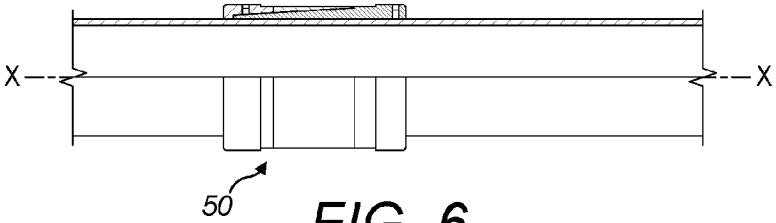
FIG. 6 shows a sealing device used in the FIG. 1 tool string to isolate adjacent zones of the well.

Referring now to FIG. 5, the port sub has a selectively actuable port 30 which comprises a sliding sleeve valve having a sleeve 32, formed with an annular arrangement of apertures 33 that move in and out of register with a side port 35 in the wall of the tool string 1 as the sleeve 32 slides axially within the bore. The sleeve 32 typically does not move until activated. Typically the sliding sleeve used can be our ARID (advanced reservoir isolation device). Activation is typically accomplished by the passage of an RFID tag through an antenna 40 having a bore that is coaxial with the axis X of the drill string 1. The RFID tag that activates the port 30 can typically be the same RFID tag that activates the reader 20, and controls the movement of the barrier device 10. Passage of the tag through the antenna 40 typically shifts the port 30 into a pressure pulse mode in which it is configured to recognise and react to pressure pulses in the bore fluid, which are used to trigger the movement of the sleeve 32.

The control mechanism for the port 30 typically has a reservoir 36, connected to a sealed annular chamber via a fuse 37, essentially as previously described for the barrier device 10. While the fuse 37 is intact, the fluid from the reservoir 36 cannot be transmitted to the sleeve 32. The fuse 37 can be activated to open the port 30 in a number of different ways, e.g. RFID tags, pressure pulses, or a combination of the two. Typically, passage of the RFID tags (which can be the same as or different from the tags that activate the barrier device 10) through the antenna 40 activates the control mechanism to blow the fuse 37, which connects the passages between the reservoir 36 and the sleeve 32. A piston in the reservoir can then be urged by a control mechanism for the port 30, allowing pressure from the reservoir to communicate with the sleeve 32 when the port 30 is to be opened. Typically the movement of the piston to pressurise the reservoir and drive the movement of the sleeve 32 can be triggered by pressure pulses detected by the pressure transducer 38, and passed to the controller. Irrespective of the activation sequence, the sleeve 32 then moves up the bore of the tool string 1 under the pressure from the reservoir, the sealed apertures 33 move into alignment with the ports 35, allowing direct communication from the inner bore to the outer surface of the tool string 1, through the aligned apertures 33 and ports 35. This allows circulation of fluid from the surface through the bore and out through the ports 35, into either the annulus or the formation. Thus once the ports 35 are opened and the flapper 12 closed, the formation can be subjected to frac'ing or other injection treatment, or circulation of fluid back to surface via the annulus. Instead of being programmed to react to RFID signals from dropped tags, the controller can optionally be programmed to blow the fuse 37 (and optionally move the sleeve) in reaction to pressure cycles received by the transducer 38. In some circumstances, the controller can be programmed to react to an RFID tag dropped from surface by activating the pressure transducer to look for pulses before blowing the fuse 37. Accordingly different triggering mechanisms can be used for the opening of the port 30.

A suitable design of RFID antenna that could be used for certain examples of this invention is disclosed in our earlier patent application WO2006/051250, which is incorporated herein by reference. The invention can be performed by using other triggering mechanisms to change the configurations of the flapper 12.

The RFID tag typically communicates a binary code to the control mechanism, which may optionally be contained (e.g. programmed) within the memory of the tag. A suitable design of tag will be known to one skilled in the art, and is disclosed in our earlier patent application number WO2006/051250. The RFID tag can typically contain: an address that can optionally be recognised only by one (or a few) designated control mechanism in one particular zone, for example the reader 20 configured to control the barrier device in zone 1 only; a command for the tools connected to the control mechanism in that zone, for example the command carried by the RFID tag for the reader 20 could optionally be "close flapper and then open flapper after a time delay of 2 hours if a valid pressure signature is detected". The same tag data could have a different message for the antenna 40, which could be "react to pressure pulses by opening sleeve".

The RFID tag can optionally also carry additional command modifiers, which can typically provide context and additional detail to the commands. For example, a command modifier carried by the tag could optionally give further information about the set sequence before the "open flapper" command could be carried out. In the present example, the command modifiers require a particular change in amplitude of pressure that must be present before the "open" command can be followed by the flapper. Likewise, the command modifiers could include a minimum time period for the amplitude of pressure to be held before the "open" command can be carried out. Likewise, the command modifiers can optionally include details of a time delay before the "open flapper" command can be carried out.

Current designs of RFID tag typically carry around 20 to 25 bytes of information. Many suitable RFID tags for use in various examples of the invention are manufactured by Texas Instruments. Programming techniques for programming the tags with the necessary address, command, and command modifier data are well known, and are published, for example, by Texas Instruments at http://www.ti.com/lit/ug/scbu018/scbu018.pdf, the disclosure of which is incorporated herein by reference.

Accordingly, the passage of the RFID tag through the antenna 20 typically triggers the control mechanism of the assembly to close the flapper 12 by triggering the "close flapper" fuse 17 in the manner above described after a set sequence such as a set delay that is typically determined by a command or a command modifier that is optionally encoded in the RFID, or is optionally pre-programmed into the control mechanism before running into the hole.

In addition, the passage of the RFID tag through the antenna 20 typically instructs the control mechanism to trigger a second "open flapper" fuse 13 at a set time interval after triggering the "close flapper" fuse 17. Fuse 13 is typically arranged in a similar manner to fuse 17, but is operatively connected to the lower sleeve 15, against which the closed flapper 12 is seated in the closed position. Typically the fuse 13 is triggered to blow and thereby connect a reservoir with a fluid supply conduit adapted to move the lower sleeve 15 in a similar manner as described for the upper sleeve 14, after a time delay following the receipt of a valid pressure signature during the "closed flapper" injection period, as specified by the control mechanism.

The triggering of the "open flapper" fuse for the lower sleeve 15 requires the pressure sensors (not shown in this section but connected to port 11) provided in the control mechanism to receive and recognise a pressure signature in the fluid conveyed (e.g. being injected) through the bore of the tool string 1. The pressure signature in the fluid must include a minimum change in pressure over a minimum time period (i.e. a minimum rate of change of pressure). Optionally, after the minimum time period has elapsed, and the change in pressure has been detected over that minimum time period, the logic sequence programmed into the control mechanism typically also requires an delay before the lower sleeve 15 is moved, allowing the flapper 12 to continue rotation around its pivot point until it is displaced at least 180° away from its original FIG. 3 starting position. In the 180° displaced configuration after the movement of the lower sleeve 15, the flapper 12 is again in parallel configuration with respect to the axis X, and no longer blocks the bore, allowing free communication through the bore, and circulation of fluid from the surface. The time delay for the lower sleeve movement can be encoded in the same RFID tag that passes through the reader 20, but the instruction given to the sleeve 15 by the control mechanism can be different, to provide a closed period when the flapper is seated against the lower sleeve 15 in the closed position, to divert the injected fluid through the port for injection procedures. Hence for an injection time of 2 hours, the command given by the control mechanism to the lower sleeve after receipt of the pressure signature might be "open 2 hours after a valid pressure signature is received". The time delays can be configured to the particular well conditions that prevail and can be modified in different examples of the invention. Time delays of between 30 minutes and 36 hours are likely to be useful in certain injection operations.

Since the pressure signature to control the barrier device can be given during the injection operation, time is saved by omitting a separate signal transfer step in the process. Also, the pressure signature can be relatively long, and can optionally last for most or all of the injection treatment, so the signature can be made more distinctive, with a high signal to noise ratio, and more tools can be controlled in the well using different signatures that vary their parameters without reduced risks of inadvertent activation of the wrong tool due to confusingly similar signatures.

Sending the signal during the injection operation is of course only one option, and can be varied in different examples, in which any treatment operation can be carried out separately from any pressure signature sent. Typically in injection operations, the pressure signature can be sent separately between the mini frac and the main frac.

Until the pressure signature is received and recognised by the closed barrier device, the lower sleeve 15 does not move and the flapper 12 remains pressed against it, in a state of waiting for the pressure signature. In such a state, the barrier device 10 remains closed indefinitely, and will not open the bore until a valid pressure signature is received and recognised. The pressure signature is typically transmitted from the surface, through the fluid in the bore, and is advantageously transmitted while the fluid is being injected into the well.

Figure 7A:
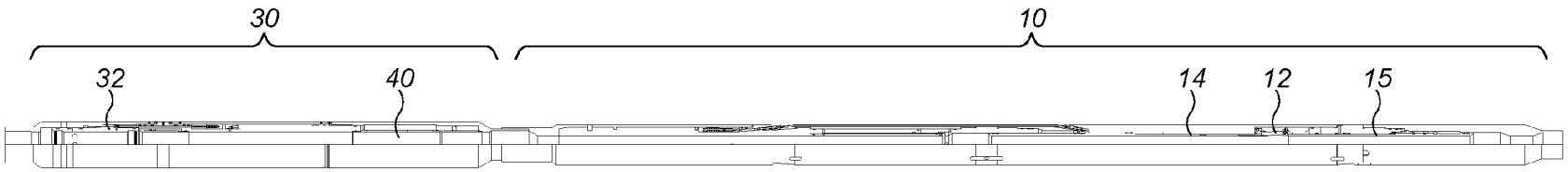
FIG. 7 *a-d* show sequential views of the FIG. 1 barrier device and the selectively actuable port in sequential stages of activation.

With reference now to FIG. 7, the tool string 1 is run into the hole in the configuration shown in FIG. 7*a*. The flapper 12 is in its first open position, and is retained there by the upper sleeve 14, which is in its lower position, preventing swinging movement of the flapper 12, and allowing full bore access through the upper sleeve 14. The lower sleeve 15 is in its upper position, ready to seat the flapper 12 when it closes. The sleeve 32 is in its lower position, and the apertures 33 are not in register with the ports 35, so no fluid communication is permitted across the selectively actuable port 30.

After being run in the FIG. 7*a* configuration, an RFID tag is circulated through the central bore of the drill string. The RFID tag passes through the central bore of the reader 40 and the reader 20, and signals the control mechanism to close the flapper 12, and to activate the sleeve 32 after a time delay to receive and react to pressure changes in the bore. The time delay is typically coded in the command modifier that is programmed in the RFID tag. For example, the time delay between flapper closing and the sleeve activating might be 10 minutes, and this can be coded in the RFID tag or stored in the memory of the control mechanism.

Figure 7B:
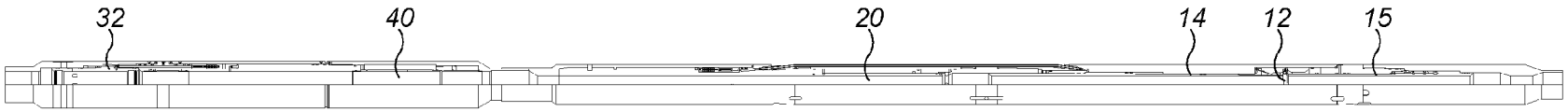
Figure 7C:
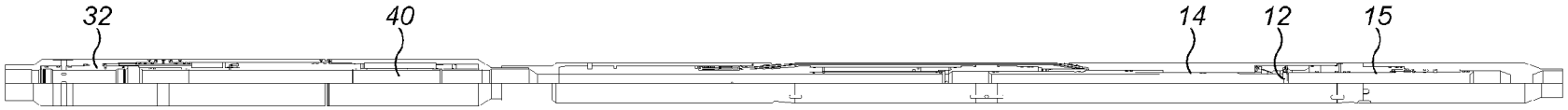
Figure 7D:
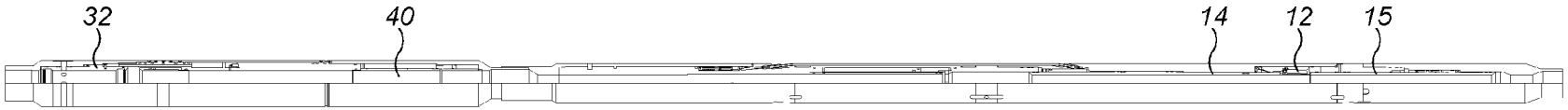

After dropping the tag through the bore in the open configuration as shown in FIG. 7*a*, the flapper closes as shown in FIG. 7*b*, and after the coded time delay, pressure readings are taken at sequential 10 second intervals. In this configuration, provided that a pressure sequence of pressure pulses is received by the pressure transducer 38, the sleeve 32 moves up so that the apertures 33 are in register with the ports 35, and communication is possible across the port 30. The assembly is then in the configuration shown in FIG. 7*c*. This allows circulation of the fluid from surface through the central bore of the tool string 1, which flows directly through the apertures 33 and ports 35 for injection into the formation, or into the annulus for clean-up operations. The bore remains closed at the flapper 12, which seats on the upper surface of the lower sleeve 15.

Figure 14:
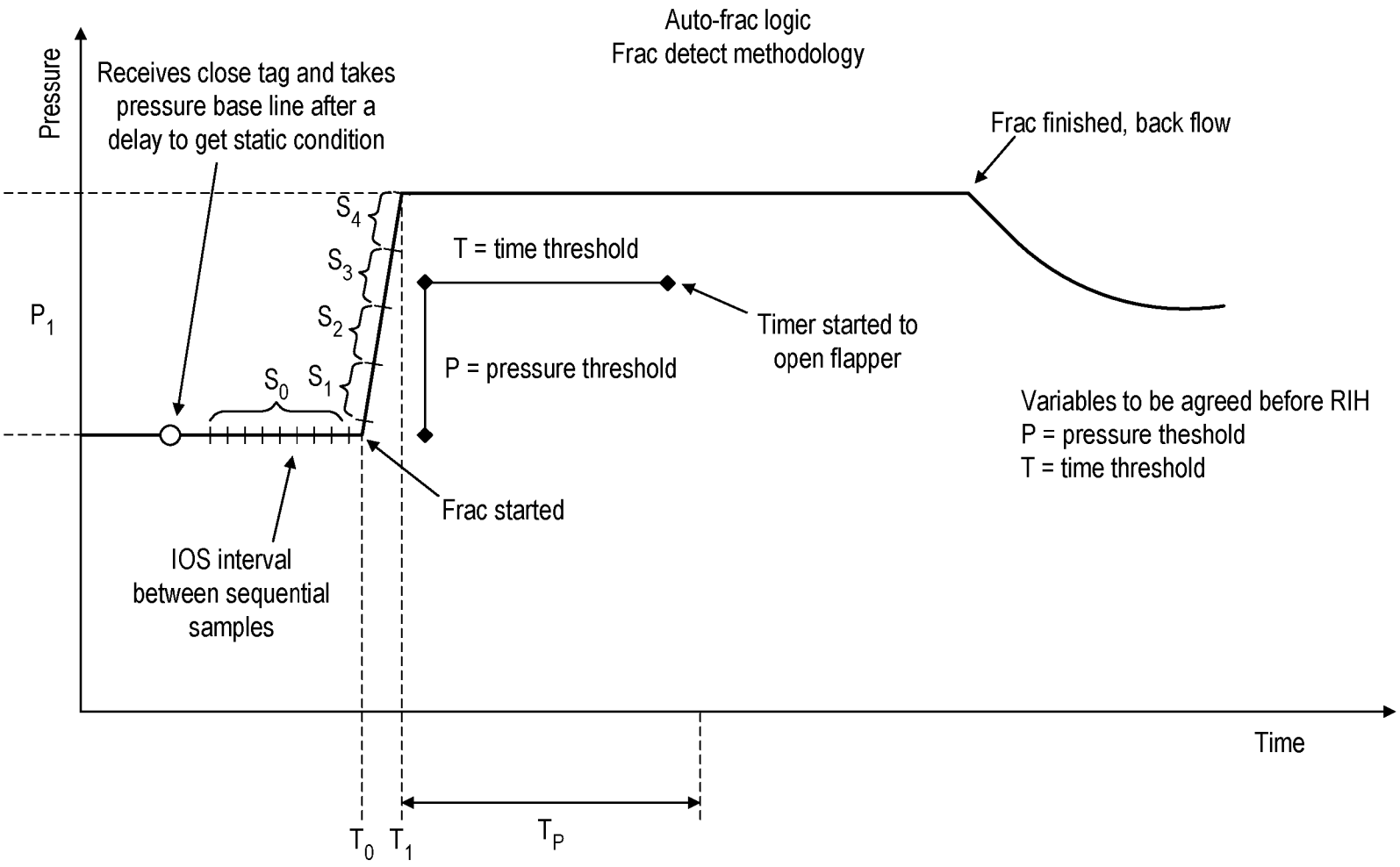
FIG. 14 shows a graph of a pressure signature used in the FIG. 1 tool string to control the configuration of the barrier device and the port.

During the injection operation, while the pressure readings are being taken at 10 second intervals, the pressure signature is conveyed in the bore fluid being injected through the bore of the tool string 1, through the ports 35, and into the formation. A typical pressure signature is illustrated graphically in FIG. 14. Consecutive pressure readings (shown immediately adjacent to one another on the graph of FIG. 14) are compared by the controller to determine whether the required minimum change in pressure is occurring in the 10 second interval between the samples. Before the pressure signature is transmitted, the controller recognises the pressure readings at S0 as invalid pressure signatures, with insufficient rates of change in pressure between adjacent 10 s readings, and takes no action. The pressure signature commences with the initiation of the frac procedure at point T0, and adjacent 10 s pressure readings between the points T0 and T1 which meet the required minimum rate of change criteria are recognised as valid pressure signatures by the controller. Optionally the controller is programmed to sample 5 sequential and contiguous samples and to initiate action on the 3rd positive sample, with the start time of the action being set as the first positive sample in the contiguous chain of positive samples. Hence the controller initiates a positive reaction as a result of the three consecutive positive readings, but in other examples of the invention, two consecutive pressure readings showing the necessary rate of change can be sufficient to register as a valid pressure signature, and to trigger the appropriate response in the tool, In typical examples, the minimum rate of change of pressure required to constitute a valid pressure signature is usually between 200 psi/min and 500 psi/min, e.g. between 300 and 400 psi/min, and in this example, the minimum required rate is 350 psi/min. A suitable range of alternative rates of change might range from around 100 psi/min to 1000 psi/min. The parameters of the minimum rate of change can be altered in different examples of the invention, and the control mechanism can be configured to recognise and react to the minimum rate of pressure change for each case.

Optionally, the pressure signature has a pressure change P1, which is optionally held for a minimum time period Tp.

The pressure signature is received by the pressure sensors in the control mechanism, and when a valid pressure signature has been received, the assembly is commanded by the control mechanism to open the flapper 12 after a time delay. If bad weather or an incomplete injection operation is encountered, the pressure signature can be aborted after starting, and provided that the complete pressure signature has not been delivered, the assembly will remain in the FIG. 7*c* configuration, with the flapper 12 closed and the sleeve 32 open, allowing a later attempt at a repeat injection operation, or other intervention if required. The activation signal can also be cancelled after being sent by sending a cancellation signal comprising a number of pulses (typically greater in number than the activation signal) before a cancellation delay has elapsed. The FIG. 7*c* configuration can be left for days or weeks before a second initiation of the pressure signature to continue with the injection operations in this zone or further up the bore. Once the pressure signature has been delivered via the injection fluid, the lower sleeve 15 is commanded to move down the bore to clear the flapper 12, which swings around its pivot point to the second open position shown in FIG. 7*d*, which still allows full bore access in the event of intervention being required below the flapper 12.

The sleeve 32 typically remains open. This concludes the injection treatment for zone one, and different zones for example zone 2, or zone 3, or a different zone in the well can then be treated in the same way by dropping an RFID tag through the central bore of the tool string 1 from the surface, to initiate the process for a separate zone.

Accordingly, different zones of the well can then be injected in a controlled manner, and the tools in the well can be controlled using highly specific and complex signatures addressed more specifically to the intended tool, and which allows a lower risk of cross recognition between tools in different zones in the well, and which are not triggered by more traditional pressure pulse operations to trigger other tools. Therefore, the different zones can be addressed and treated with greater accuracy, and more zones can reliably be treated and then produced in a controlled manner.

Figure 8:
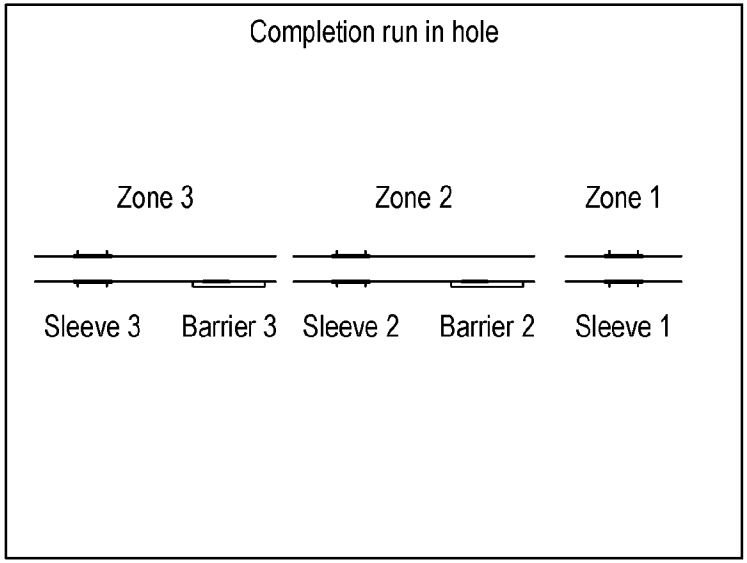
FIGS. 8 to 13 show sequential schematic views of the FIG. 1 tool string showing the different stages of activation of the barrier device and selectively actuable port.

Referring now to FIGS. 8 to 13, the sequence of operation is shown schematically for a 3-zone well. The tool string is run into the hole to total depth, and landed in place, with each production zone having at least one sleeve, and typically also at least one barrier device as shown in FIG. 8. In the run in configuration, all sleeves are typically closed, and all barriers are typically open, allowing full bore access into the well. Each sleeve typically covers a selectively actuable port, and each barrier typically comprises a flapper. Sleeve 1 at the lower end is initially programmed when run in to receive and react to an "open" signal transmitted through the fluid in the bore. Typically the "open" signal is a series of pressure pulses, for example 3× pressure pulses each lasting for three minutes. The pressure pulses typically require a specific rate of change in pressure measured within the window, and the required number of repetitions before the sleeve recognises the pressure pulses as a valid 'open" signal. In the run in configuration, barrier 2 is typically programmed to receive and react to five-minute pressure pulses, but the command signal from the pressure pulses is typically interpreted by barrier 2 as an instruction to activate the barrier 2 RFID reader. Prior to receiving the pressure pulses which open sleeve 1 and switch barrier 2 to RFID detection, barrier 2 is typically non-responsive to RFID tags, even carrying a valid signal.

Typically the sleeve 2 above barrier 2 is also run in already configured to detect and react to pressure pulses in the fluid, but typically the pressure pulses required to deliver a valid signal to sleeve 2 are different from the pressure pulses required to deliver a valid signal to sleeve 1. For example, in this example, the pressure pulses required to deliver a valid signal to open sleeve 2 are 5 minute pressure pulses, typically consisting of a series of 3×5 minute pressure pulses having a particular rate of change in a particular time window. Accordingly, the 3 minute pressure pulses which activate and change the configuration of barrier 2 and sleeve 1 do not affect sleeve 2. Barrier 3 and sleeve 3 are typically run into the hole in a hibernating condition, and do not (at this time) react to the pressure pulses used to change the configuration of the lower sleeves and barriers.

Figure 9:
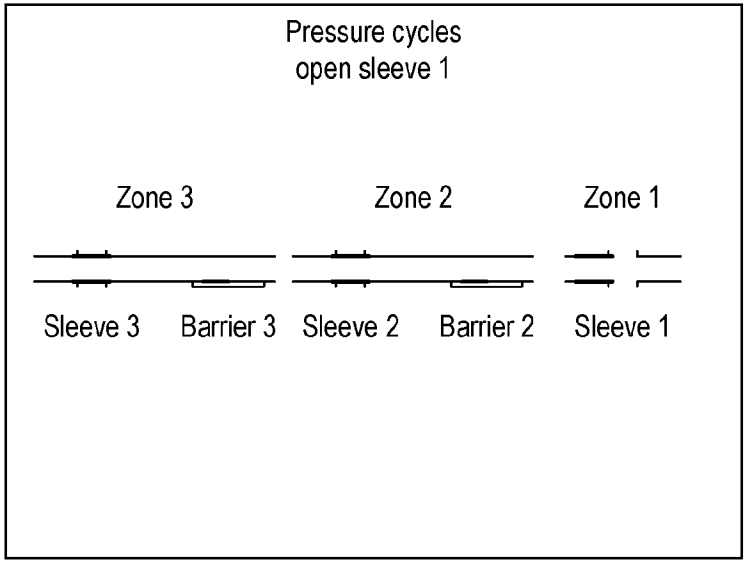
Figure 10:
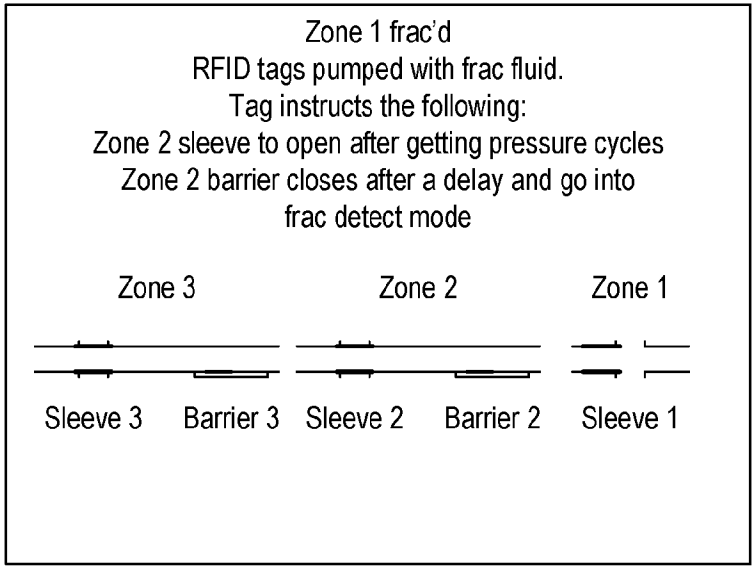
Figure 11:
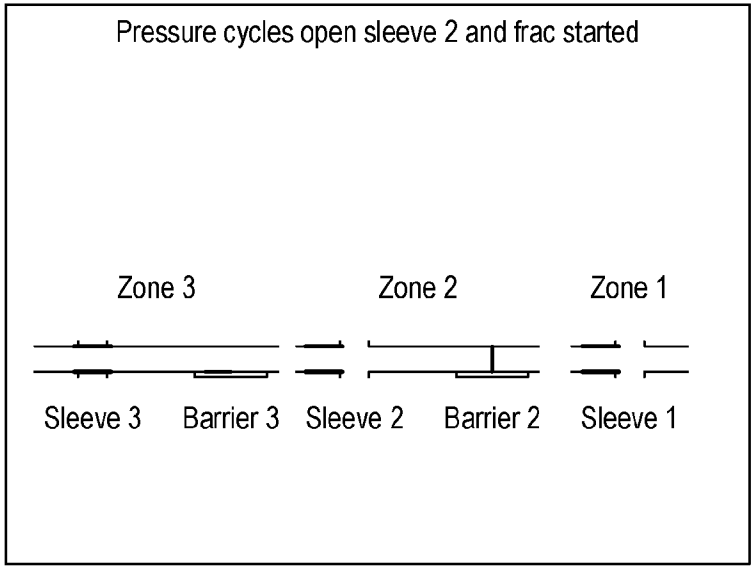

Once the pressure pulses have been delivered to the FIG. 1 assembly and sleeve 1 is open as shown in FIG. 9, this allows a frac'ing or other injection operation to be conducted in zone 1, allowing fluid to be pumped through the bore of the assembly, and be injected into the formation through the port previously covered by sleeve 1. The frac'ing operation or other injection operation can continue until determined by the operator at the surface. Barrier 2 is typically run in from surface pre-programmed to receive and react to RFID signals. Thus, when the frac operation has concluded for zone 1, an RFID tag is dropped to change the configuration of barrier 2, which has an activated RFID reader, and is looking for the required RFID signal from the dropped tag in order to change the configuration of the flapper from open to closed. Since barrier 2 has a different address to the other barriers in the well, the RFID tag only instructs the change and configuration of barrier 2, and it is typically ignored by the other barriers in the well. This configuration is shown in FIG. 10.

The tags dropped through the well during the frac'ing operation on zone 1 also instructed barrier 2 to close after a specific time delay and then enter a different mode which programs the pressure sensor in the barrier 2 to look for the pressure signature coded in the frac fluid. The same tag typically instructs sleeve 2 (which typically has the same address) to look for pressure cycles (typically five-minute pressure cycles as previously described), and instructs sleeve 2 to open after receiving the correct sequence of pressure cycles. Optionally sleeve 2 can be run into the hole already configured to look for pressure cycles.

Figure 12:
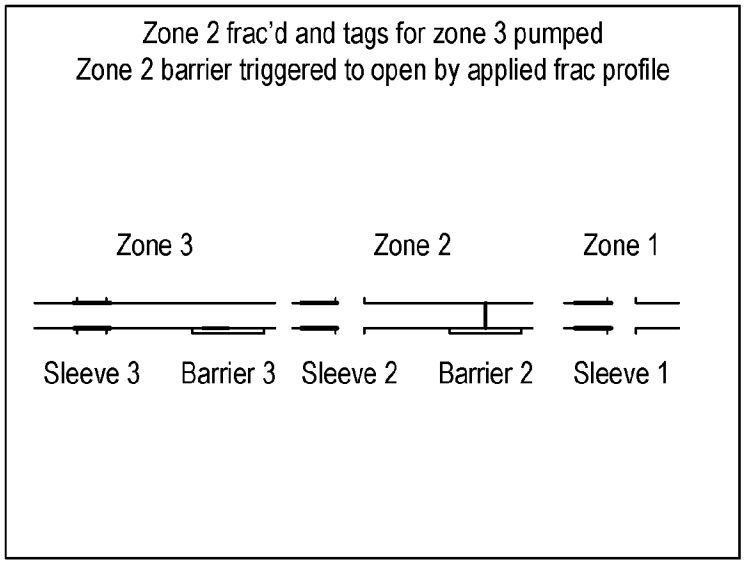

Accordingly, barrier 2 then closes after the required time delay following the RFID signal, thereby closing off the bore below barrier 2. At this stage, the well can be left dormant in a safe state if weather conditions are not favourable, or if the supply boats required for the frac operations need to return to port for re-supply. After any dormant period, pressure cycles are then applied to open sleeve 2, and zone 2 can then be frac'ed or otherwise treated by injection through the aperture exposed by sleeve 2 as shown in FIG. 12. The injection fluid is used to transmit the pressure signature (shown in FIG. 14) to barrier 2, which is triggered to open after a particular delay by the pressure signature used, or by the RFID tag previously dropped, or by a command profile that is saved in the memory of the barrier 2 control mechanism.

Figure 13:
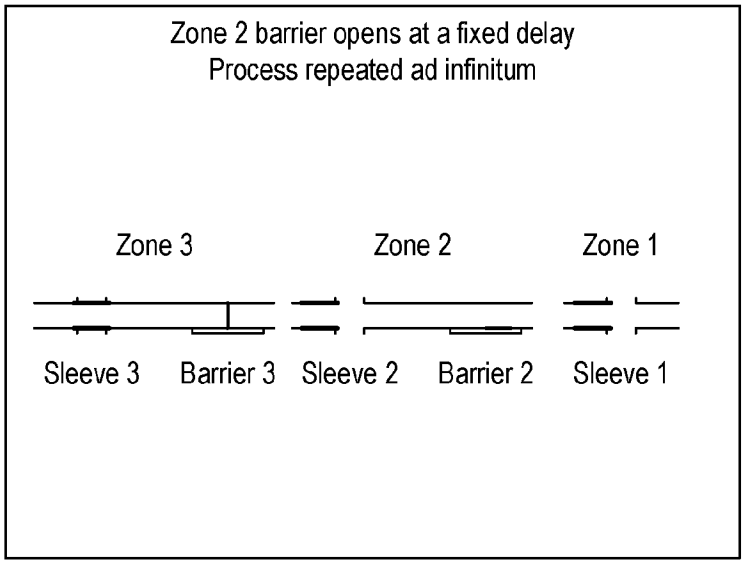

As shown in FIG. 13, the zone 2 barrier then typically opens after the fixed delay allowing production of fluids at a later stage. A recirculation pathway is provided through the open sleeve 2, allowing the dropping of further tags to close barrier 3 in the same manner as described with respect to FIG. 10. The process can be continued in subsequent zones in the well.

Figure 15:
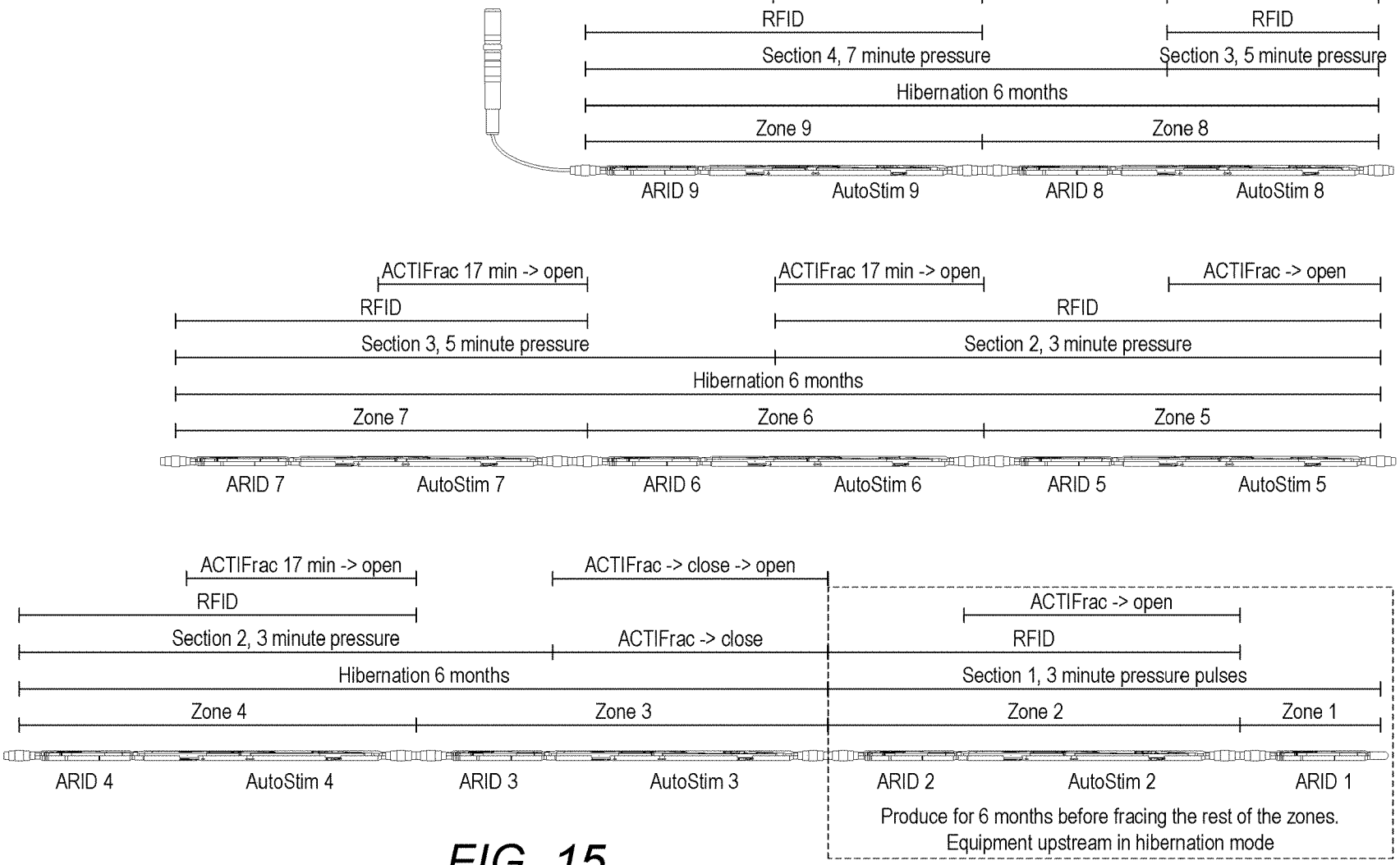
FIG. 15 shows a schematic arrangement of a second completion string run into a multi-zone well.

A further example of the invention is described with reference to FIGS. 15-30. FIG. 15 shows a schematic arrangement of a completion string run into a multi-zone well. FIGS. 16 to 23 show a sequential series of views of a flow chart of the steps taken to treat the different zones of the well with a frac treatment. These figures should be viewed with reference to FIG. 24, which shows the different actions taken and the activation status of the different tools in each stage.

Figure 16:
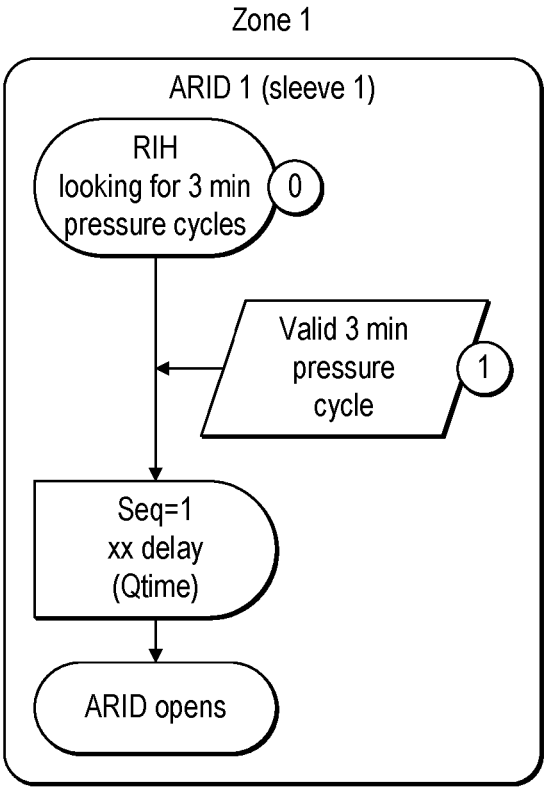
FIGS. 16 to 23 show a sequential series of views of a flow chart showing the steps taken to treat the different zones of the well referred to in FIG. 15.

The completion string shown in FIG. 15 is run into the well (in step 0) with the sleeves (marked ARID or AS in the figures) closed and the flappers (marked autostim or AV in the figures) open. In zones 1 and 2 the sleeves 1 and 2 and flapper 2 are configured on running in to detect and react to 3 minute pressure pulse signals in the wellbore fluid as shown in FIG. 16. Typically all other tools in the string (in zones 3-9) are run into the hole in hibernation for a set period configured at the surface, typically 6 months (although this can be varied in different embodiments). Upon activation, the hibernating tools are configured to detect and react to pressure pulses as shown in FIG. 24. Each tool typically has a control mechanism configured to control the operation of the tool dependent on the pressure signatures, pressure cycles in the well, and RFID tags dropped from surface.

After the string has been run into the hole in step 0, and communication through the string has been established, the through bore beneath the sleeve in zone 1 is closed, typically by a dart or ball that is dropped from surface. Alternatively, another flapper similar to the autostim flappers could be provided in the string for this purpose. At this point, the liner hangar at the top of the string is set, and the packers isolating adjacent zones begin to swell to isolate the zones, the upper completion and well head are installed and tested (typically taking up to 6 weeks to do so).

Zone 1: FIG. 16

When the completion string is installed and zone 1 is to be treated, the sleeve in zone 1 is opened by a sequence of 3 minute pressure pulses which are generated in the fluid in the string as step 1, and which signals to sleeve 1 to open, typically after a delay, e.g. a 60 minute delay, and signals to sleeve 2 and flapper 2 to switch to tag mode, i.e. to detect and react to RFID tags passing through the antenna in the wellbore. The 3 minute pressure pulses have no effect on the sleeves and flappers in the other higher zones of the well, as they are all in hibernation and do not detect the pulses. See FIG. 24 which shows the activation status of the tools in the string at different stages of the process.

Figure 25:
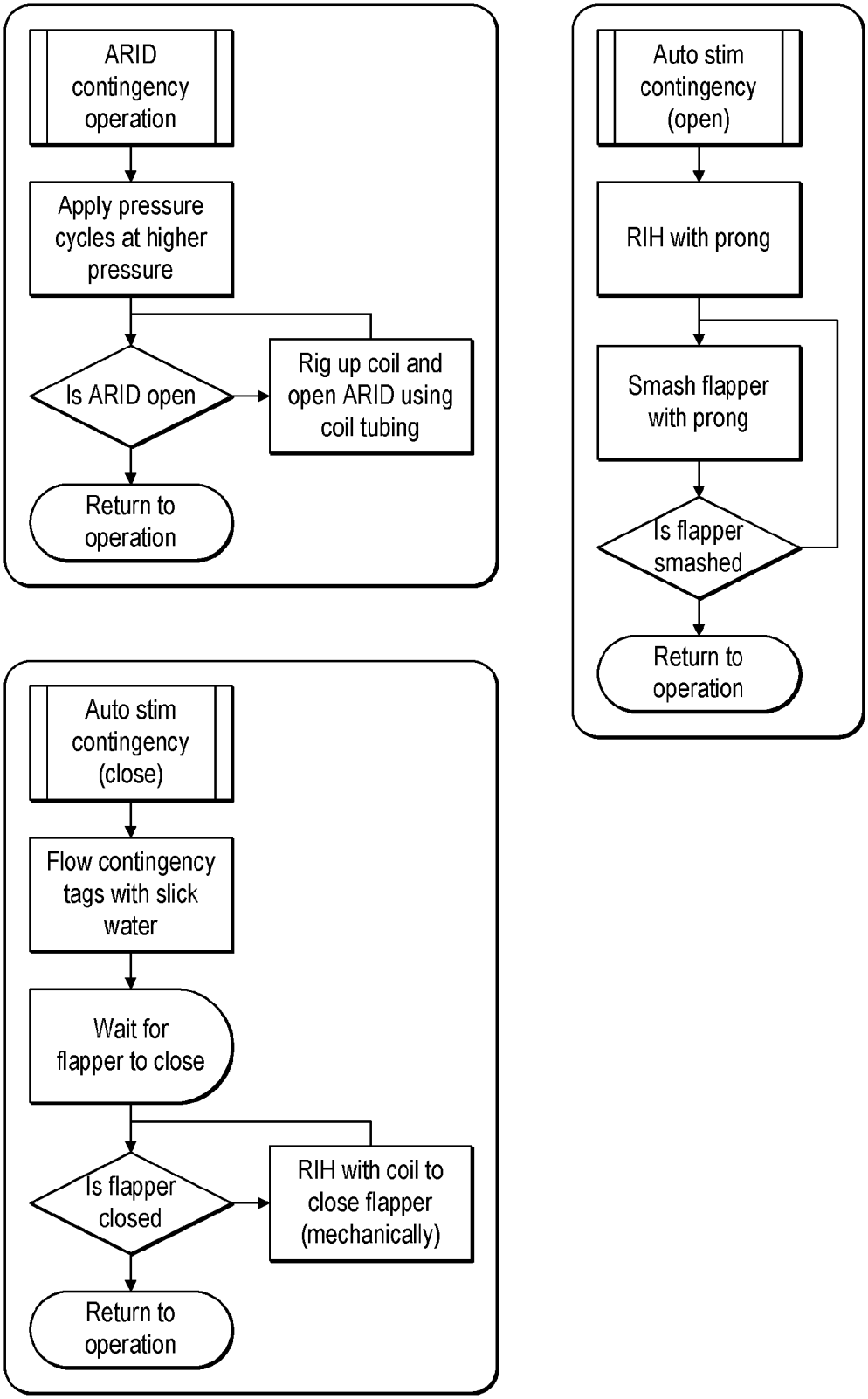
FIG. 25 shows a schematic arrangement of the contingency measures used to operate the tools in FIG. 15 in the event of failure of the primary activation mechanism.

If sleeve 1 fails to open, the pressure pulse signal can be repeated, and if still unsuccessful, the tools in zone 1 and 2 (and in other zones) can be programmed to enter a contingency operation shown in FIG. 25, which can be varied in different situations to suit the well conditions, but in the example shown comprises coiled tubing intervention from the surface to manually open sleeve 1 typically by engaging the sleeve with a shifting tool on the coiled tubing, and pulling up from the surface.

Once sleeve 1 is open, a conduit is provided for fluid between the wellbore and the formation in zone 1 through the open sleeve, zone 1 can be stimulated by frac treatments injected into the well. In preparation for this, the surface equipment is rigged for frac treatment, and RFID tags are loaded into a launcher at the surface for deployment into the well. A series of frac treatments are then conducted, including typically at least one "mini-frac" treatment involving the injection of a test fluid such as water into the well and through the sleeve into the formation in order to test the formation properties prior to the main frac treatment. At this mini-frac stage, the operator can check for pressure build up and release profiles in the zone so that the main frac treatment can be more accurately tailored for the particular requirements of the zone.

When the operator is satisfied with the data collected and the main frac treatment has been configured using the data, the main frac treatment for zone 1 (typically including proppant) can be delivered through the completion string. The different frac treatments typically stimulate production of fluids from zone 1, and may result in enhanced recovery of usable production fluids containing higher levels of valuable hydrocarbons from the zone. Frac treatments of zone 1 can be repeated or varied in order to stimulate later production of the zone.

Optionally, produced fluids can be recovered from zone 1 flow through the open sleeve 1 and into the wellbore, for recovery to the surface, being deflected upwards in the completion string (usually within production tubing arranged concentrically in the completion string) by the plug on the end of the string. However, in this example, at least zones 1 and 2 of the well are typically frac'ed sequentially, before production of any zone begins.

Figure 17:
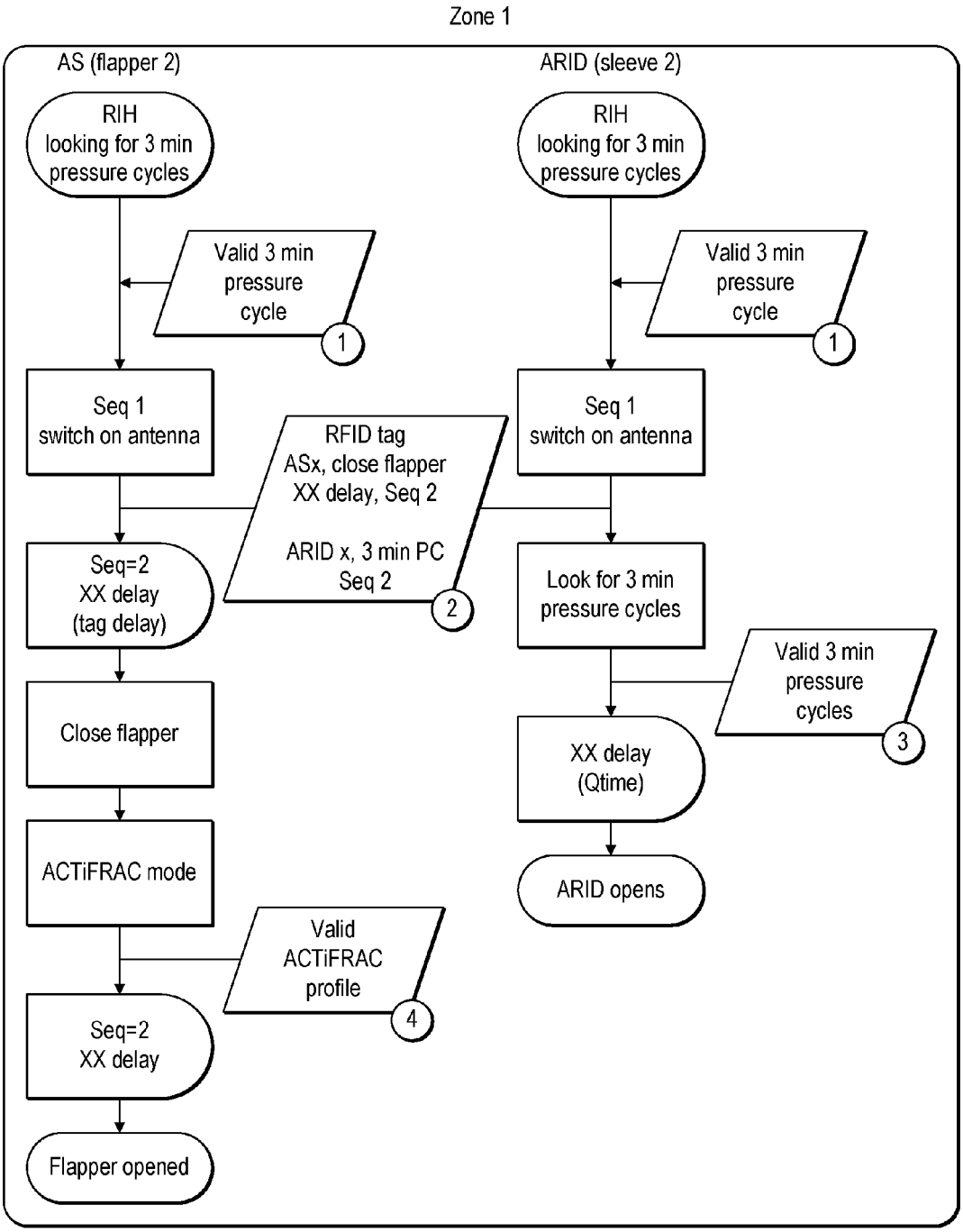

Zone 2: FIG. 17

Typically RFID tags are loaded in a launcher at the surface and are delivered in step 2 with or shortly before the final frac treatment of zone 1, and carry a signal as shown in FIG. 17 to flapper 2 and sleeve 2 (which have active antennae operating in tag mode as a result of the earlier 3 minute pressure cycles) in zone 2. At this point, sleeve 2 is closed, and flapper 2 is open. Sleeve 1 is open following the 3 m pressure pulses of step 1, providing a circulation pathway for the fluid carrying the tags. The RFID tags delivered with the main frac treatment in zone 1 are detected by the antennae on flapper 2 and sleeve 2 within zone 2. The RFID tags instruct flapper 2 to close after a delay (e.g. 3 hrs) and switch to Acti-frac detect mode in which it is configured to detect and react to pressure signatures in the wellbore fluid in accordance with the invention comprising a minimum rate of change of pressure after the flapper closes. The tags also switch sleeve 2 to detect and react to 3 minute pressure pulses, and to open after detecting 3 minute pressure pulses. The tags could optionally switch the sleeve to react to different sequences of pressure pulses, e.g. 3, 5 or 7 minute pressure pulses or some other sequence, which could be programmed into the firmware of the sleeve, and activated by the passage of the tag. The instructions included on the RFID tag typically incorporate a delay instruction (or this delay can be programmed into the tool when running in) before flapper 2 is closed, which can vary in different examples of the invention depending on the complexity of the well and the time needed to complete the frac operation.

Typically the RFID tags carrying these instructions are launched into the well near to the end of the frac operation of zone 1, when enough proppant has been injected into the formation for a satisfactory frac treatment of the zone, and when it is possible to estimate the remaining time to conclude the frac operation on zone 1 with reasonable certainty so that all frac operations can be concluded within the delay period, before the flapper closes. A typical delay included on the coding of the RFID tags might be 3 to 4 hours, but can be varied. Once the RFID tags have been launched with the main frac treatment of zone 1, and the countdown has commenced to the close of flapper 2 to close off zone 1, the wellbore can be flushed to displace any residual proppant in the borehole below flapper 2.

After closure of flapper 2, and testing of the integrity of the seal (typically by holding pressure against the closed flapper 2), 3 minute pressure pulses are then applied in step 3 to the closed system in order to open sleeve 2 above the closed flapper in zone 2. The pressure pulses can be repeated if sleeve 2 fails to open, and if repeated pressure pulse signals do not achieve opening, sleeve 2 can be opened manually using coiled tubing as shown in FIG. 25.

Once sleeve 2 has opened, the flapper at the bottom end of zone 2 is closed and is configured to detect and react to a pressure signature in the wellbore fluid in accordance with the invention to change its configuration. Sleeve 2 is open, allowing frac treatments to be carried out on zone 2 in order to stimulate production from zone 2 in the same way as is described above in respect of zone 1, typically commencing with a number of test procedures, optionally including a mini-frac treatment to assess the reservoir qualities of zone 2. This may optionally include breakdown treatments and chemical injection in order to enhance the quantity or quality of valuable production fluids produced from the reservoir of zone 2, and to assess the pressure build up and release profiles of the zone.

Figure 26:
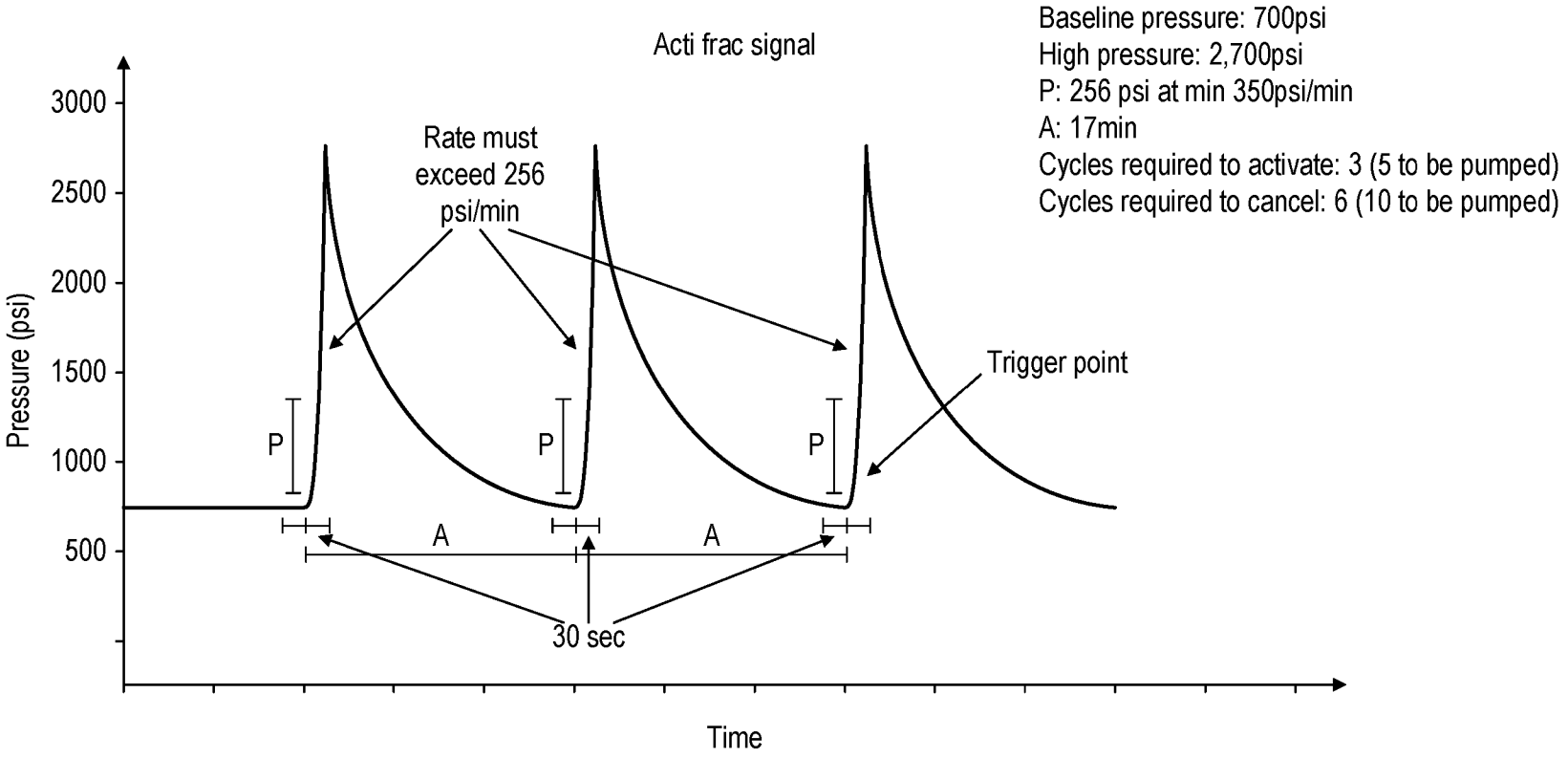
FIG. 26 shows a graph indicating a typical pressure signature in accordance with the invention, used to operate the tools in FIG. 15.

During (or typically before) the final frac treatment is applied to zone 2, a pressure signature (referred to as "actifrac" in the figures) in accordance with the invention is transmitted in the fluid being injected into the well during the frac operations at step 4. The pressure signature comprises a minimum rate of pressure change in the injected fluid. A typical pressure signature applied to the fluid is shown in FIG. 26. Starting from a baseline pressure of 700 psi, the pressure is rapidly increased from the surface pumps at a minimum rate of 350 psi/min, and is sampled by a pressure gauge (typically located in the zone) at 10 second intervals. Typically, the pressure spikes at between around 2000 and 3000 psi, although the actual pressure reached is variable in different examples of the invention, because the controller typically takes the valid signature from the rate of increase rather than the quantum of the pressure reached. The controller is configured (typically by being programmed at the surface before running into the hole) to react to 3 pressure cycles matching the required minimum rate profile shown in FIG. 26.

Typically 5 cycles are pumped from the surface, each lasting approximately 30 seconds, and at intervals of approximately 17 minutes between each pressure cycle, and the first 3 consecutive cycles that are recognised by the controller constitute a valid actifrac pressure signature according to the invention sufficient to change the configuration of flapper 2. Flapper 2 is configured to open following a delay (typically 2 days) after receiving a valid pressure signature, such as that shown in FIG. 26 having a minimum rate of change. Opening of flapper 2 re-establishes the conduit for circulation of fluid through the well bore. If flapper 2 fails to open, the contingency operation as shown in FIG. 25 is to run into the hole with a prong on coiled tubing or the like, and to smash the closed flapper into an open configuration. As can be seen in FIG. 24, subsequent actions taken on the well have no effect on the configuration of the tools in zones 1 and 2 after this point, which remain in the same open configuration for the remainder of the life of the well.

The well is then in the configuration shown at the bottom of FIG. 17, with flapper 2 open, sleeves 1 and 2 open and the remaining sleeves closed. At this stage, the wellbore can be flushed to displace any residual proppant remaining in the wellbore below flapper 3.

The well can then be produced from zones 1 and 2 for an extended period, usually lasting for the hibernation period of the remaining zones. Alternatively, the well can be flowed in an extended well test prior to frac'ing of the remaining zones. The hibernation period of the remaining zones can be controlled in different examples to extend for different lengths of time.

Figure 18:
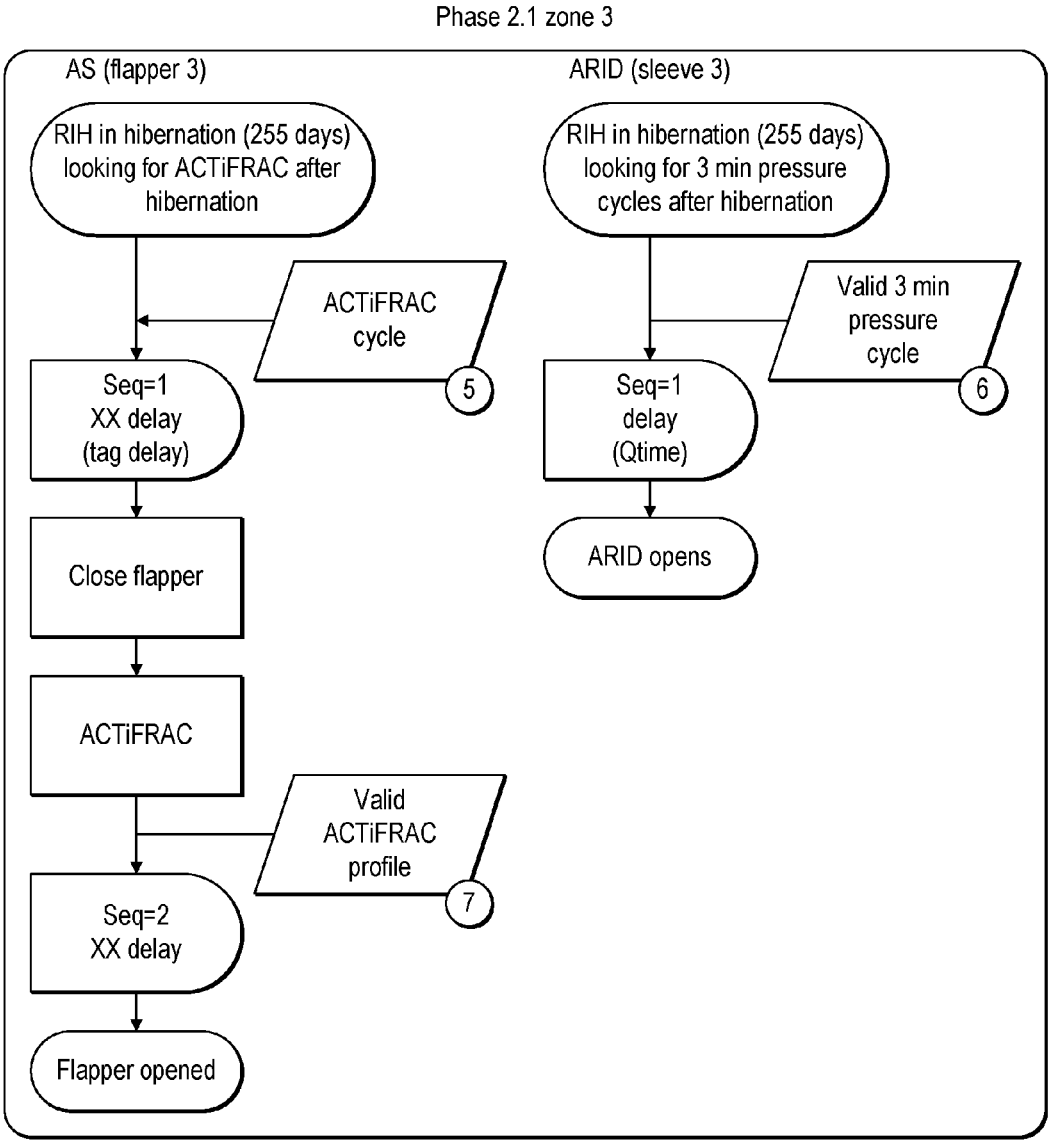

Zone 3: FIG. 18

The remaining zones above zone 2 are treated in a similar manner, having tools that are run into the hole in hibernation, and which are programmed to activate after the hibernation period (for example 6 months, but this period can be varied by the operator in different examples of the invention) in pressure pulse mode being programmed to detect and react to pressure pulses. Typically the tools in each zone are programmed at surface before running in to detect and react to pressure pulses with different characteristics once they are activated after the hibernation period. For example, the tools in zone 3 can be programmed to detect and react to 3 minute pressure pulses (for example having a three-minute period between initiation of pressure increase, and fall of pressure after being held). The tools in zone 4 can be programmed to react to five-minute pressure pulses, and in zone 5, the tools can be programmed to react to 7 minute pressure pulses. Accordingly, different pressure pulses signals can be generated in the wellbore fluid in order to activate specific zones in the well.

After the hibernation period, all flappers are open, and the sleeves above flapper 3 closed (typically the sleeves below the active zone remain open after production moves up a zone).

Before the well is frac'ed in zone 3, the flapper in zone 3 is typically shifted from open to closed. This is typically achieved by step 5 of sending a pressure signature (actifrac) constituting a minimum rate of pressure increase, in accordance with the invention, and typically as shown in FIG. 26. Flapper 3 is programmed to close on receipt of a valid pressure signature of this nature, after a programmed delay, which in this case is approximately 60 minutes. If it does not close, then it is closed manually according to the contingency operation shown in FIG. 25, using coiled tubing.

After the flapper has closed below zone 3, the wellbore is pressured up to confirm closure of flapper 3 and to verify the closed system above it. The 3 minute pressure pulses are then applied from the surface in step 6 to shift sleeve 3 from closed to open (typically after a delay of 30 mins or some other time) and optionally to activate all of the antennae in the tools above the zone 3 up to the flapper in zone 6 to detect and react to RFID tags in the wellbore. Typically, depending on the hibernation time period, the tools in the string above zone 3 can optionally remain in tag mode, searching for RFID tags for approximately 30 to 40 days dependent on battery life. However, in certain examples, the 3 minute pressure pulses can be used to activate only certain zones, for example zones 3 to 6, whereas other zones, 7, 8 and 9 for example, can typically be programmed to activate only when a different pressure pulse is transmitted, for example 5 minutes or 7 minutes in period. Optionally, higher zones can be left in hibernation for longer periods than lower zones, which saves on battery life.

Typically, while only one sequence of pressure pulses is sufficient to activate the antennae and open sleeve 3, the pulses are repeated a number of times (for example 7 times), until sleeve 3 is observed to open. If the sleeve does not open, and repeat pressure pulse cycles have failed to remedy the situation, the contingency is typically to use coiled tubing and a shifting tool to mechanically open the sleeve (see FIG. 25).

At this stage, the flapper 3 is closed and is configured to detect and react to pressure signatures in accordance with the invention (i.e. typically as shown in FIG. 26); sleeve 3 is open, and zone 3 can then be treated by injection of fluids and/or frac treatment to stimulate later production from the zone as previously described. Typically the mini frac treatment is followed by (in step 7) an actifrac pressure signature in accordance with the invention, which is transmitted in the fluid injected through the string as part of the frac treatment injection operations in zone 3. Typically the pressure signature is in accordance with the profile shown in FIG. 26. This instructs flapper 3 to open after a delay, which can typically be about 3 hours as previously described. In the present example, a longer delay between the transmission and recognition of a valid pressure signature as shown in FIG. 24 and the opening of the flapper can be 10 days, and the pressure signature can be transmitted during the frac procedure at a relatively early stage in the frac treatment of zone 3, allowing a sufficient length of time to complete the frac treatment in zone 3. After the actifrac pressure signature in accordance with the invention as shown in FIG. 26, the main frac is carried out to inject proppant into the formation in zone 3, while the flapper 3 is still closed.

After the main frac treatment of stage 3, flapper 3 opens after its delay period, sleeves 1-3 are open, and the remaining sleeves above zone 3 are closed.

Figure 19:
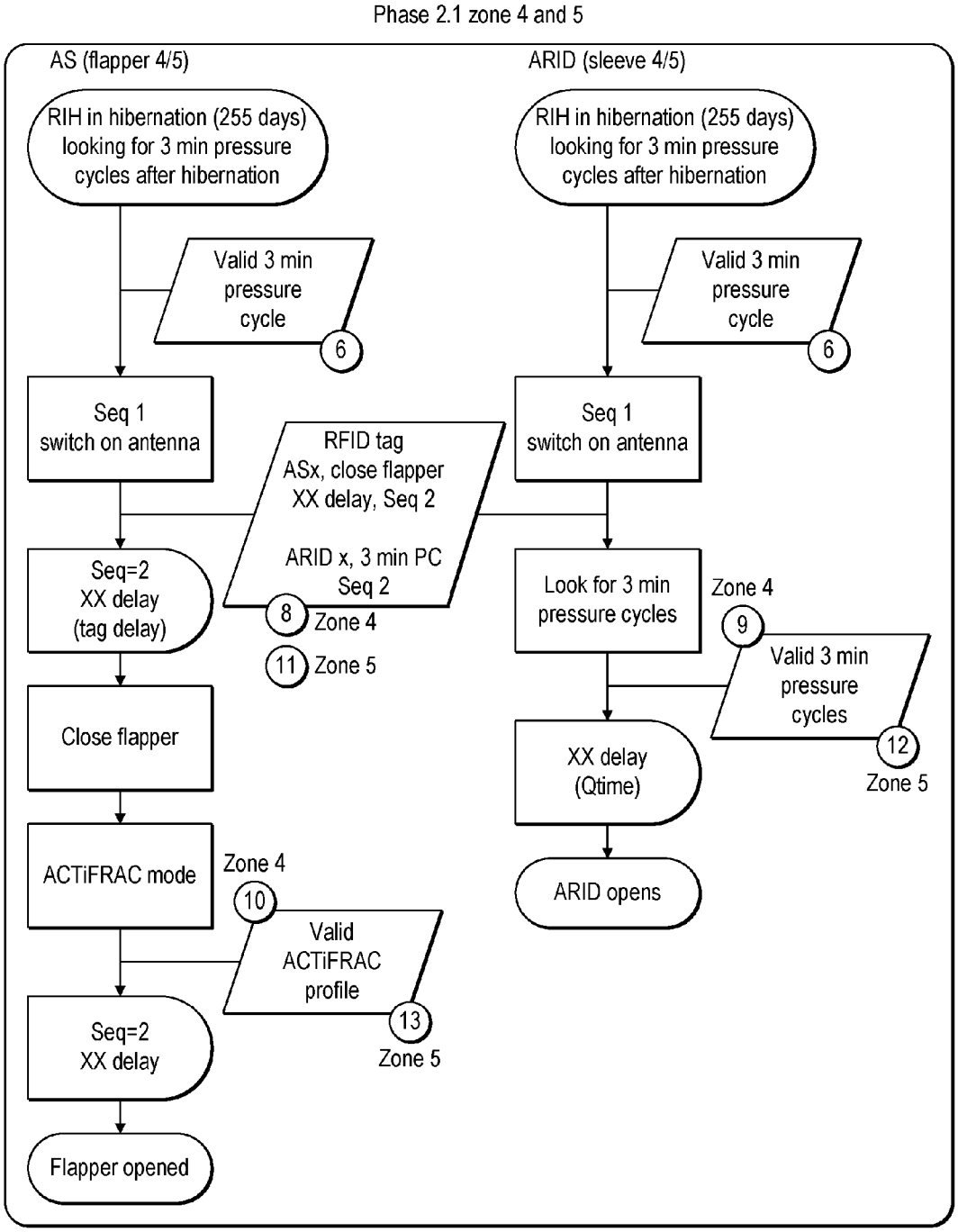

Zone 4: FIG. 19

The 3 minute pressure pulses of step 6 have previously activated the antennae of the sleeves and flappers above zone 3 and up to the flapper of zone 6, which are then programmed to respond to RFID tags. Specifically, in this example, the pressure pulses of step 6 activated the RFID receiving-antennae of the flapper and sleeve in zones 4 and 5, and the flapper of zone 6.

To initiate zone 4 frac treatment, RFID tags are loaded into the launcher at the surface in step 8 and pumped through the string. The tags are addressed to flapper 4, and they instruct flapper 4 to close and enter ActiFrac frac detect mode to detect and react to a pressure signature transmitted in the wellbore fluid in accordance with the invention. The tags of step 8 also switch sleeve 4 to pressure pulse mode, to detect and react to 3 min pressure pulses (other intervals between pressure pulses could be programmed into the firmware of the sleeve, which could be activated by the tag). Sleeve 4 is opened by a three-minute pressure pulse signal in step 9. A further pressure signature according to the invention as shown in FIG. 26 is then delivered through the wellbore fluid in step 10, which is received by flapper 4, which opens after a delay of 10 days (or some other period specified by the tags or when RIH).

Zone 4 is frac'ed in the interim while flapper 4 is still closed. Typically in the previously described sequence of a mini-frac, followed by an actifrac pressure signature in accordance with the invention (typically as shown in FIG. 26) to open flapper 4, which can be transmitted at a phase of frac treatment of zone 4 when the completion of frac treatment in that zone can be reliably estimated, as previously described. The main frac of zone 4 comprising the injection of proppant then typically follows the actifrac pressure signature (or the two are combined) as the duration of the main frac treatment is usually reasonably quantifiable.

After frac'ing of zone 4 is complete, the flapper 4 opens after its programmed delay. In this configuration, sleeves 1-4 are open and the sleeves above zone 4 are closed. Typically the operator can move up to frac zone 5 before the lower flapper of zone 4 is still closed.

If flapper 4 does not open in response to the pressure signature, it can be manually smashed with a prong on coiled tubing as previously described with reference to FIG. 25.

Zone 5: FIG. 19

Zone 5 is produced in substantially the same way as zone 4. The sleeve and flapper in zone 5 are both in tag mode, their antennae having been activated by the pressure cycles in previous step 6. Tags are pumped from the surface in step 11, addressed to flapper 5, which close flapper 5 and instruct it to enter ActiFrac frac detect mode to detect and react to a pressure signature transmitted in the wellbore fluid in accordance with the invention. Again the profile of the pressure signature is typically as shown in FIG. 26. The tags of step 11 also switch sleeve 5 to pressure pulse mode, to open after 3 minute pressure pulses. This step is useful so that sleeve 5 is dormant during frac'ing of zone 4, when earlier pressure pulses were used to open sleeve 4. Sleeve 5 is then opened by a three-minute pressure pulse signal in step 12 pumped against the closed flapper. This opens a conduit through the string and Zone 5 is frac'ed through the open sleeve 5 in the interim while flapper 5 is still closed. Typically the frac treatments applied to zone 5 are as previously described, comprising a mini frac to test the formation properties and compile the data necessary for setting the parameters of the main frac to inject proppant, followed by a further actifrac pressure signature according to the invention which is delivered through the injected wellbore fluid in step 13. This actifrac pressure signature is detected by flapper 5, which opens after a delay of 10 days (or some other period).

Typically, the pressure signature to open flapper 5 is transmitted between the mini and main fracs in zone 5. In some examples, the pressure signature to open flapper 5 can be transmitted at a phase of production of zone 5 when the completion of production operations in that zone can be reliably estimated, as previously described. If flapper 5 does not open in response to the pressure signature, it can be manually smashed with a prong on coiled tubing as previously described. Typically the main frac treatment to inject proppant into the formation in zone 5 is performed after the actifrac pressure signature.

Additional zones can be completed in the manner described for zones 4 and 5 above.

Figure 20:
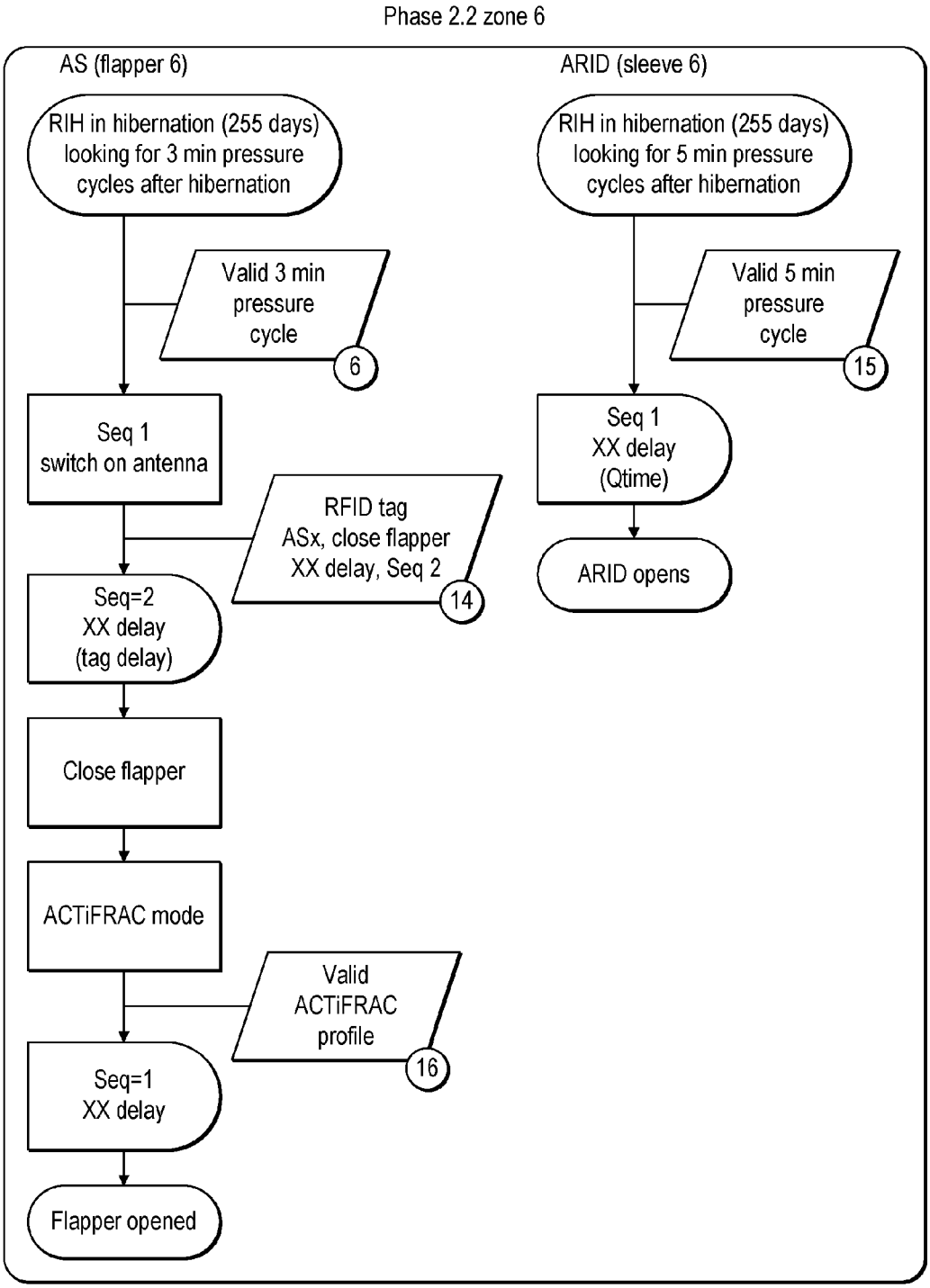

Zone 6: FIG. 20

Sleeve 6 and all sleeves and flappers in zones 7 and 8 have previously been run into the hole awaiting five-minute pressure pulses after awakening from hibernation. The flapper in zone 6 has been switched into tag mode by the pressure pulses in previous step 6.

Zone 6 is initiated in step 14 by pumping tags from surface to close flapper 6. The step 14 tags instruct flapper 6 to close (optionally after a delay) and switch flapper 6 to ActiFrac frac detect mode, so that it is programmed to detect and react to pressure signatures according to the invention transmitted in the wellbore fluid.

Optionally the tags to close flapper 6 can be dropped as part of the frac operation in zone 5, typically in the last part of the frac operation. Optionally this flapper could be set up as per flapper 3. This could be used to allow a period of production or another extended well test. Alternatively, the tags addressed to flapper 6 can be dropped following cessation of frac operations in zone 5.

Once flapper 6 is closed, in step 15, a 5 minute pressure pulse signal is transmitted from the surface into the closed system. This 5 minute pressure pulse signal opens sleeve 6, and switches the sleeve and flapper of zone 7 and the flapper of zone 8 to tag mode, so that they detect and react to RFID tags dropped through the antennae. Typically, sleeve 6 opens after a delay, typically 40 mins. If sleeve 6 fails to open, the contingency is shown in FIG. 25, using coiled tubing to open the sleeve manually.

Zone 6 is frac'ed in the interim period, when flapper 6 is closed, and sleeve 6 is open, typically with breakdown treatments and mini-frac treatments as previously described, followed by an actifrac pressure signature according to the invention which is delivered through the injected frac treatment in step 16, typically followed by the main frac treatment to inject proppant into the formation in zone 6, as previously described for other zones. The actifrac pressure signature transmitted in step 16 is typically as shown in FIG. 26. It is detected by flapper 6, which reacts by opening after a delay of 10 days (or some other period e.g. 5 days). The step 16 actifrac pressure signature also switches sleeve 8 to look for 7 minute pressure pulses. Accordingly, after step 16, all tools above flapper 8 are configured to react to 7 minute pressure pulses, as best shown in FIG. 24*b*.

Figure 21:
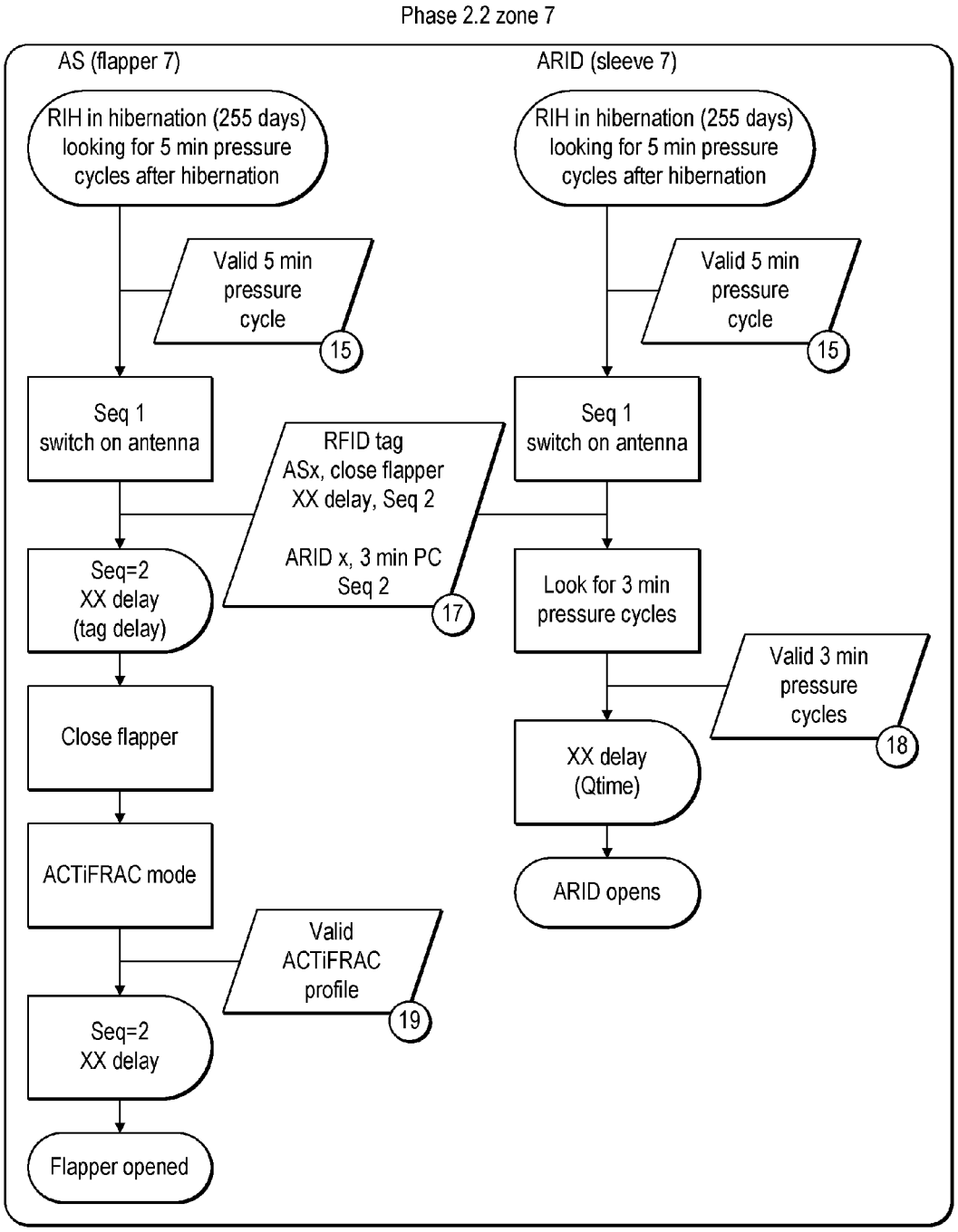

Zone 7: FIG. 21

The 5 min pressure pulses in previous step 15 have already activated the antennae of the tools in zone 7, and flapper 8 which are all now searching for tags in the wellbore.

In step 17, RFID tags are then pumped from surface addressed to the flapper of zone 7, instructing it to close after a delay and enter ActiFrac frac detect mode, so that it is programmed to detect and react to a pressure signature in the wellbore fluid in accordance with the invention (actifrac). The tags in step 17 typically also switch sleeve 7 into pressure pulse detect mode, so that sleeve 7 is then programmed to detect and react to 3 minute pressure pulse signals in the wellbore fluid.

In step 18, sleeve 7 is opened by transmitting 3 minute pressure pulses into the wellbore fluid against the closed flapper 7. Once sleeve 7 opens as a result of the 3 minute pressure pulses in step 18, the frac treatment of zone 7 can be carried out in a similar manner as is described above, typically comprising a mini frac treatment to assess the formation properties, and establish the correct parameters for the main frac treatment for zone 7, typically followed by the main frac treatment of zone 7 to inject proppant into the formation in zone 7, as previously described for other zones. An actifrac pressure signature in accordance with the invention (as shown in FIG. 26) is transmitted in step 19 is detected by flapper 7, which reacts by opening after a delay of 10 days (or some other period, e.g. 5 days). Typically the step 19 actifrac pressure signature to open flapper 7 is transmitted near the completion of the frac operations in zone 7, typically just before or during the main frac treatment, as described above.

Figure 22:
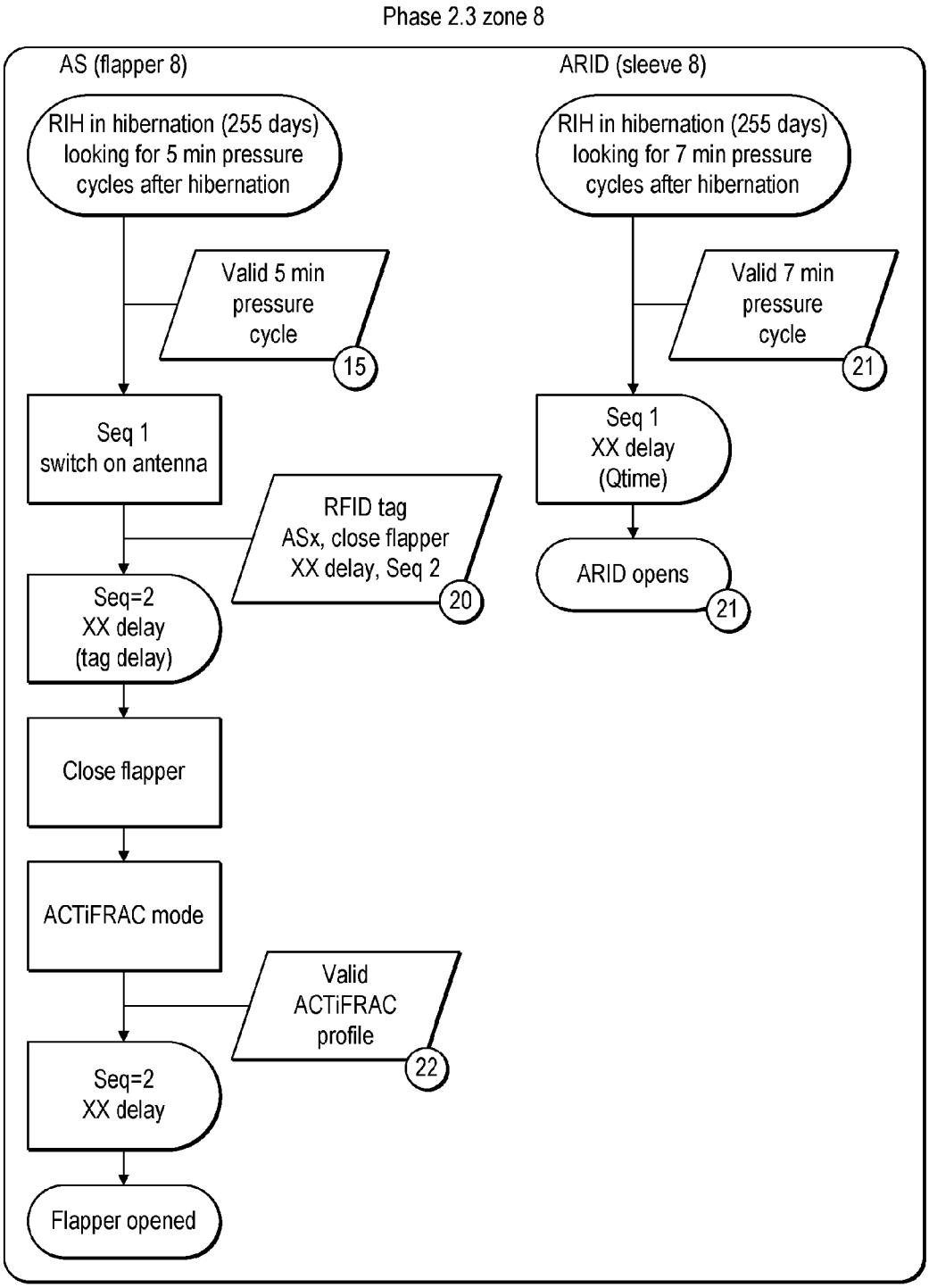

Zone 8: FIG. 22

Zones 8 and 9 are treated in the same way as zones 6 and 7, with different pressure pulse intervals being used to avoid premature activation of the tools in the higher zones (the tools in zones 8 and 9 react to pressure pulses with 5 and 7 minute periods rather than 3 and 5 minute periods).

In step 20 tags are pumped from surface addressed to flapper 8, which is in tag mode, having been switched by the pressure pulses in step 15 as described above. The step 18 tags instruct flapper 8 to close (optionally after a delay) and switch it to actifrac mode, so that it is programmed to detect and react to pressure pulses according to the invention, which are transmitted in the wellbore fluid.

Sleeve 8, and the sleeve and flapper in zone 9 have already been switched to react to 7 minute pressure pulses by previous step 16. In step 21, the sleeve in zone 8 is opened by 7 minute pressure pulse cycles transmitted from the surface once the flapper in zone 7 is closed as a result of the tags in step 20. Sleeve 8 typically opens after a short delay, e.g. 60 minutes. If the sleeve does not open, the pressure pulses can be repeated, and/or the contingency operations shown in FIG. 25 can be employed. The 7 minute pressure pulses of step 21 also switch the flapper and sleeve in zone 9 into tag mode so that they detect and react to suitably addressed RFID tags in the wellbore.

Zone 8 is frac'ed when flapper 8 is closed and sleeve 8 is open. The frac treatment applied to zone 8 is typically similar to that previously described for other zones, typically comprising a mini frac treatment to assess the formation properties, and to establish the parameters for the main frac treatment, typically followed by the main frac treatment of zone 7 to inject proppant into the formation in zone 8, as previously described for other zones. An actifrac pressure signature in accordance with the invention (as shown in FIG. 26) is transmitted in step 22 is detected by flapper 8, which reacts by opening after a delay of 10 days (or some other period). Typically the step 22 actifrac pressure signature is transmitted near the completion of the frac operations in zone 8, typically just before or during the main frac treatment, as described above. The actifrac pressure signature transmitted in step 22 is detected by flapper 8, which reacts by opening after a delay of 10 days (or some other period).

Figure 23:
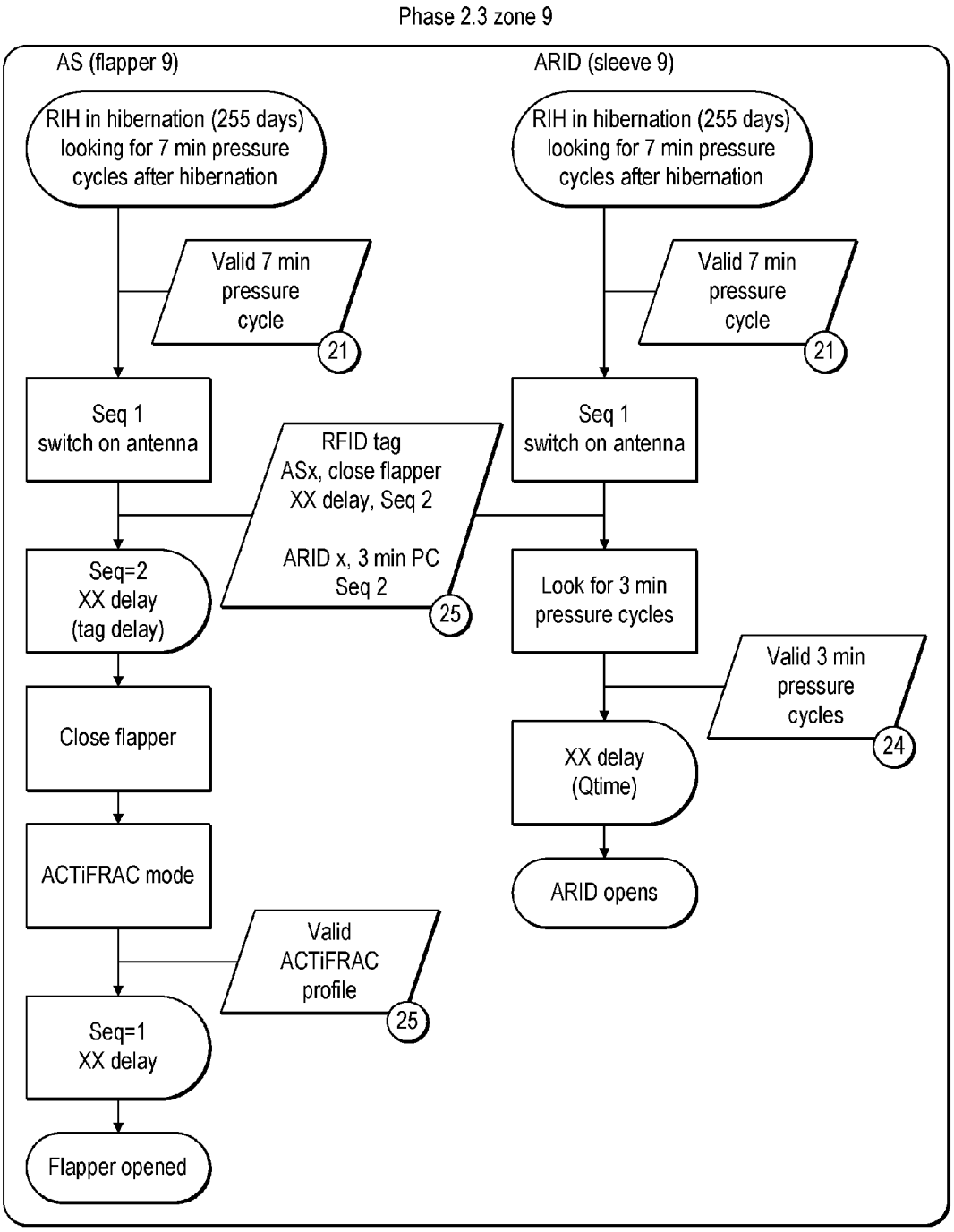

Zone 9: FIG. 23

The 7 min pressure pulses in previous step 21 have already activated the antennae of the tools in zone 9 which are now searching for tags in the wellbore.

In step 23, RFID tags are then pumped from surface addressed to the flapper of zone 9, instructing it to close after a delay and enter Actifrac detect mode, so that it is programmed to detect and react to a pressure signature in the wellbore fluid in accordance with the invention (actifrac). The tags in step 22 typically also switch sleeve 9 into pressure pulse detect mode, so that sleeve 9 is then programmed to detect and react to 3 minute pressure pulse signals in the wellbore fluid.

In step 24, after flapper 9 has closed, sleeve 9 is opened by transmitting 3 minute pressure pulses into the wellbore fluid against the closed flapper 9. Once sleeve 9 opens as a result of the 3 minute pressure pulses in step 24, the frac treatment of zone 9 can be carried out in a similar manner as is described above, typically comprising a mini frac treatment to assess the formation properties, and establish the correct parameters for the main frac treatment for zone 9, typically followed by the main frac treatment of zone 9 to inject proppant into the formation, as previously described for other zones. An actifrac pressure signature (typically as shown in FIG. 26) is transmitted in step 25 is detected by flapper 9, which reacts by opening after a delay of 10 days (or some other period). Typically the step 25 actifrac pressure signature is transmitted near the completion of the frac operations in zone 9, typically just before or during the main frac treatment, as described above.

In each case, the actifrac pressure signature in accordance with the invention is typically as shown in FIG. 26, incorporating a minimum rate of change in the pressure transmitted in the wellbore fluid. Typically a valid pressure signature in accordance with the invention requires 3 spikes each lasting for approximately 30 seconds, repeated at 17 minute intervals as indicated in FIG. 26, but typically 5 cycles are pumped from surface, for redundancy, to ensure that within the 5 cycles, there are 3 chances of recognising the 3 spikes.

The actifrac pressure signature in accordance with the invention can typically be cancelled in each stage within a short period after being sent, by sending a cancellation signal comprising 6 pressure spikes repeated at 17 minute intervals as shown in FIG. 26. Typically, a valid cancellation signal requires the 6 repeat pressure spikes, and typically 10 repeat spikes are sent from surface in order to ensure redundancy and multiple chances of recognising the cancellation signature at the tool.

Figure 27:
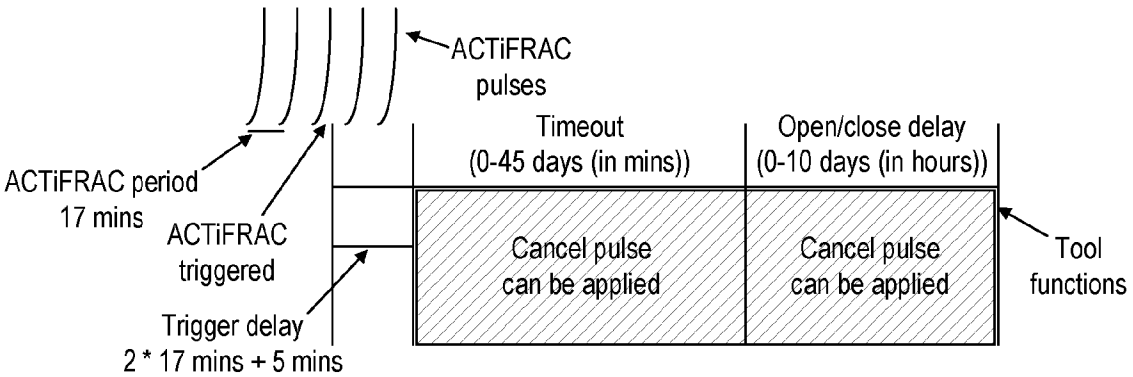
FIGS. 27-30 show graphical representations of the activation process of various tools in FIG. 15.

FIG. 27 shows a schematic layout of pressure signatures in accordance with the invention. In accordance with FIG. 27 a sequence of 5 actifrac pressure pulses with a repeating period of 17 minutes are sent from surface, and typically after the 3rd pulse, the downhole equipment being triggered by the pressure signature recognises a valid signature. Starting from that recognition point, the downhole tool enters a trigger delay period in which pressure cycles are ignored, in order to allow additional cycles of pressure signatures to be sent, in the event of tool failure. After the trigger delay period, there is typically a timeout period lasting between 0-45 days in which a cancellation signal can be sent. In certain examples, the timeout period expires before the tool activates in response to the valid pressure signature, and in other examples, the timeout period can persist up to the moment that the tool activates in response to the valid pressure signature.

Figure 28:
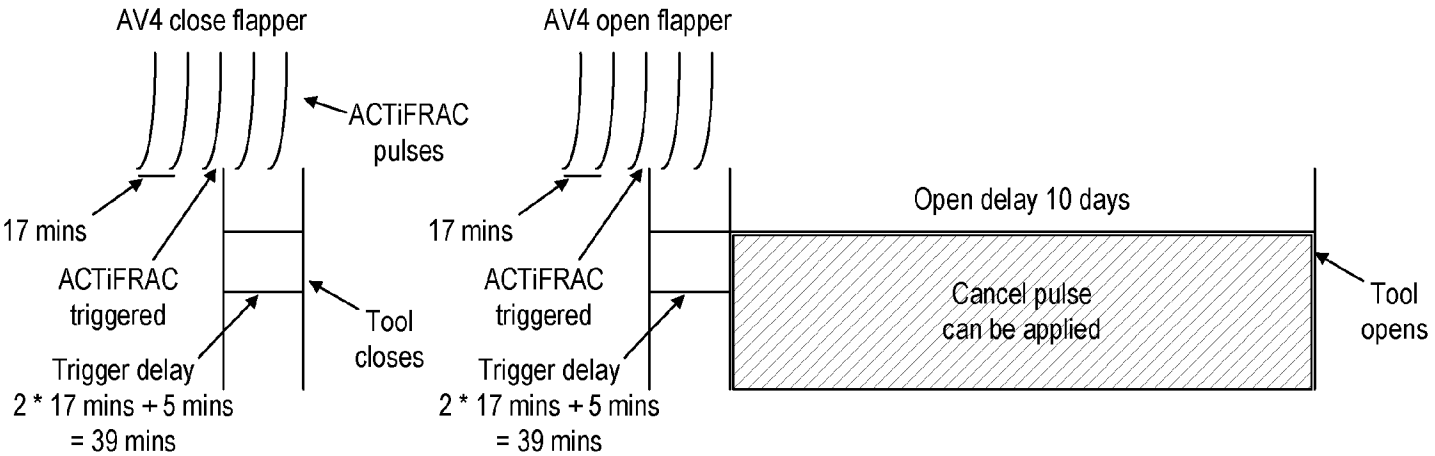

FIG. 28 shows a schematic layout of the pressure signature that is applied to the zone 4 flapper. As can be seen in FIG. 28, flapper 4 recognises the valid pressure signature on the 3rd repeat of the actifrac pulse, and enters a trigger delay period in which flapper 4 ignores the additional pulses sent from surface. After the trigger delay (typically at least 39 minutes to accommodate the remaining 2 actifrac pressure pulses) flapper 4 enters a timeout period before activation during which flapper 4 is sensitive to cancellation signal is sent from the surface to cancel the "open flapper" instruction sent by the actifrac pressure signature.

Figure 30:
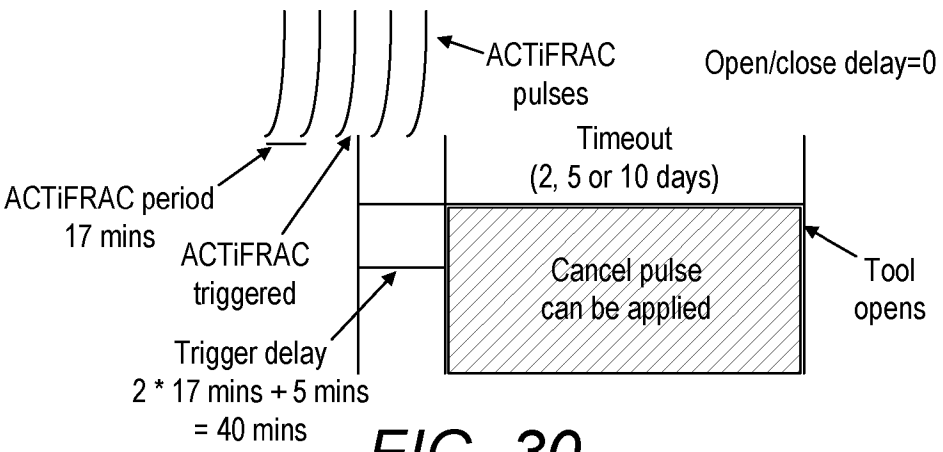
Figure 29:
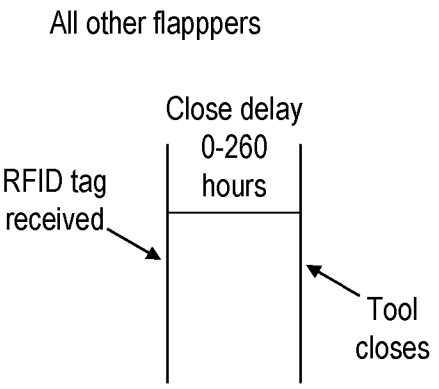

FIG. 29 shows a schematic layout of the instructions conveyed to other flappers to close the flapper after a delay following the recognition of an RFID tag passing through the antenna associated with the flapper. FIG. 30 shows the equivalent actifrac logic used to open other typical flappers in the well, which is similar to the logic used to open flapper 4 as shown in FIG. 28, but typically with different timeout periods applying.

The contingency operations set out in FIG. 25 for operating the sleeves and flappers in the event of failure of the initiating signal can be applied to any of the sleeves and flappers in the well.

Typically RFID tags dropped during or near the point of frac treatments can be dropped in the wellbore while a frac treatment is being carried out.

After frac operations have been completed for all zones in the well, the well can be produced as normal.

Modifications and improvements can be incorporated without departing from the scope of the invention.

The invention claimed is:

1. A method of controlling flow in a bore of an oil or gas well, the method comprising:

providing a control mechanism in the bore, configured to detect a pressure signature in a fluid in the bore, and generating a pressure signature in the fluid in the bore and transmitting the pressure signature to the control mechanism to trigger a change in the configuration of a flow control device in the bore in response to the detection of the pressure signature in the fluid;

wherein a positive pressure signature effective to trigger the change in configuration of the flow control device requires a sequence of at least two pressure changes, each pressure change having a non-zero minimum rate of change of pressure, with a measured time interval between each pressure change.

2. A method as claimed in claim 1, including sampling the pressure in the fluid in the bore at time intervals, recording at least one sampled pressure measurement, and comparing the recorded pressure measurements with another sampled pressure measurement to determine the rate of change of pressure in the fluid.

3. A method as claimed in claim 2, including continuously recording the pressure in the fluid in the bore at regular time intervals, and continuously comparing sequential measurements to determine the positive pressure signature.

4. A method as claimed in claim 3, the measured time interval between the pressure changes in the sequence incorporates a time window comprising a +/− deviation from the endpoint of the measured time interval, and wherein the pressure change must occur within the time window for the positive pressure signature to be recognized by the control mechanism.

5. A method as claimed in claim 1, wherein the positive pressure signature requires the sequence to include more than two pressure changes.

6. A method as claimed in claim 1, wherein the positive pressure signature requires that the at least two pressure changes are consistent in an increasing direction.

7. A method as claimed in claim 1, wherein the positive pressure signature requires two pressure changes.

8. A method as claimed in claim 1, wherein the positive pressure signature requires two or more minimum pressure changes each with the necessary minimum rate of change, occurring within the measured time interval before the control mechanism recognises the pressure changes as a valid signature to trigger the change in configuration of the flow control device.

9. A method as claimed in claim 1, wherein the positive pressure signature requires a number of pressure spikes each fulfilling the necessary minimum rate of change of pressure, and having the measured time interval between each spike.

10. A method as claimed in claim 9, wherein each spike comprises a minimum positive rate of change of pressure followed by a decrease in pressure value.

11. A method as claimed in claim 1, wherein the positive pressure signature requires a number of pressure spikes each fulfilling the necessary minimum rate of change of pressure, wherein the necessary minimum rate of change of pressure is sustained over a minimum number of sampled time intervals, and the repetition of a valid pressure spike is within the required measured time interval.

12. A method as claimed in claim 1, wherein the positive pressure signature is a first positive pressure signature; and including triggering activation of the flow control device with the first positive pressure signature, and cancelling the activation before the change in configuration of the flow control device by sending a second positive pressure signature to trigger de-activation of the flow control device, wherein the first positive pressure signature is different from the second positive pressure signature.

13. A method as claimed in claim 12, wherein the second positive pressure signature is transmitted within a cancellation time window following the transmission of the first positive pressure signature, and wherein the control mechanism recognises and responds to the second positive pressure signature only if it is transmitted within the cancellation time window.

14. A method as claimed in claim 1, wherein the positive pressure signature is transmitted via fluid flowing within the bore.

15. A method as claimed in claim 14, wherein the fluid conveying the positive pressure signature comprises fluid being injected into the bore.

16. A method as claimed in claim 14, wherein the positive pressure signature is transmitted between or as part of fracturing operations comprising the injection of fluid into the well.

17. A method as claimed in claim 1, wherein the positive pressure signature is transmitted from the surface.

18. A method as claimed in claim 1, wherein the positive pressure signature comprises a rise in pressure above a sampled threshold and wherein the pressure is maintained above the threshold for a minimum time period before reducing below the threshold.

19. A method as claimed in claim 18, wherein the pressure is maintained at a constant level above the threshold during the minimum time period.

20. A method as claimed in claim 1, including sampling a baseline pressure before the positive pressure signature is applied, and comparing the pressure signature to the baseline pressure in order to verify the minimum rate of change of pressure required for a valid positive pressure signature.

21. A method as claimed in claim 1, wherein a valid positive pressure signature detected by the control mechanism triggers the flow control device to change configuration after a time delay following the detection of the valid pressure signature.

22. A method as claimed in claim 1, wherein parameters of the configuration change of the flow control device as a result of the positive pressure signature are conveyed to the control mechanism after running into a well.

23. A method as claimed in claim 1, wherein the bore includes a selectively actuable port having an open configuration allowing fluid to pass through the port and thereby to exit the bore, and a closed configuration which denies fluid passage through the port, and wherein the string is run into the well with the port closed and the port is then opened after the string is in place in the well, and wherein the selectively actuable port is controlled by a port pressure signature carried by the fluid in the well.

24. A method as claimed in claim 23, wherein the selectively actuable port is activated by the control mechanism to receive and react to the port pressure signature, and wherein in the absence of the activation of the port by the control mechanism, the selectively actuable port does not react to the pressure pulses in the fluid in the bore.

25. A method as claimed in claim 1, wherein the flow control device includes a barrier device.

26. A method as claimed in claim 25, wherein the barrier device is located below a selectively actuable port, and wherein once the barrier device has been closed, the control mechanism activates the selectively actuable port to receive and react to a port pressure signature.

27. A method as claimed in claim 1, wherein the bore is divided into separate zones, each zone being isolated from other zones in the well, and each zone having a respective flow control device, a selectively actuable port, and a control mechanism, and wherein the flow control device, port and control mechanism in each zone are controlled independently of the flow control device, port or control mechanism in other zones.

28. A method as claimed in claim 27, wherein the positive pressure signature triggers different responses from at least one of the flow control device, selectively actuable port and control mechanism in different zones.

29. A method as claimed in claim 27, wherein each flow control device comprises a barrier device, the method including the following steps:

passing a first RFID tag through the bore to close the barrier device in a first zone;

applying a port pressure signature in the fluid in the bore to open the selectively actable port;

injecting fluid from surface through the bore, keeping the barrier device closed, so that fluid is diverted through the open port, into the formation in the first zone;

transmitting the pressure signature during fluid injection to communicate to the barrier device to open after a time delay (Td) following the pressure signature; and passing a second RFID tag through the bore to close the barrier device in a second zone prior to repeating at least some of the steps in the second zone.

30. A method as claimed in claim 1, wherein the positive pressure signature requires that the at least two pressure changes are consistent in a decreasing direction.

31. A flow control assembly for use in an oil or gas well, comprising:

a bore to convey fluid between the surface of the well and a formation;

a flow control device located in the bore, the flow control device having first and second configurations, to divert fluid in the bore;

a control mechanism configured to detect pressure changes in the fluid in the bore, wherein the control mechanism is programmed to trigger a change in the configuration of the flow control device in response to the detection of a pressure signature in the fluid comprising a sequence of at least two pressure changes, each pressure change having a non-zero minimum rate of change of pressure, with a measured time interval between each pressure change.

32. A flow control assembly as claimed in claim 31, having at least one pressure sensor to take pressure measurements, and a recorder to record pressure measurements.

33. A flow control assembly as claimed in claim 31, wherein the control mechanism has a timer device to control a time delay between the detection of the pressure signature and the change in configuration of the flow control device.

34. A flow control assembly as claimed in claim 31, wherein the bore includes a selectively actuable port having an open configuration allowing fluid to pass through the port and thereby to exit the bore and a closed configuration which denies fluid passage through the port.

35. A flow control assembly as claimed in claim 34, wherein the selectively actuable port is responsive to control signals comprising a port pressure signature carried by the fluid in the well.

36. A flow control assembly as claimed in claim 35, wherein the selectively actuable port is insensitive to pressure port signature control signals until the port is activated by the control mechanism.

37. A flow control assembly as claimed in claim 31, wherein the flow control device includes a barrier device.

38. A flow control device as claimed in claim 37, wherein the barrier device is located below a selectively actuable port, and whereby closing the barrier below the port enhances the ability of the port to react to pressure changes in the fluid in the closed bore, and diverts fluid through the port when the port is opened.

39. A method of controlling flow in a bore of an oil or gas well, the method comprising:

providing a control mechanism in the bore, configured to detect a pressure signature in a fluid in the bore, generating a pressure signature in the fluid in the bore wherein the pressure signature comprises at least two pressure changes in the fluid occurring within a minimum time period, each pressure change having a non-zero minimum rate of change of pressure, transmitting the pressure signature to the control mechanism, measuring pressure in the fluid in the bore at measured time intervals at the control mechanism; and triggering a change in the configuration of a flow control device in the bore in response to a detected difference between pressure measurements by the control system at two consecutive time intervals where a non-zero rate of change of pressure occurs in each of the at least two pressure changes within the minimum time period.

40. A method of controlling flow in a bore of an oil or gas well, the method comprising:

providing a control mechanism in the bore, configured to detect a pressure signature in a fluid in the bore, and generating a pressure signature in the fluid in the bore and transmitting the pressure signature to the control mechanism to trigger a change in the configuration of a flow control device in the bore in response to the detection of the pressure signature in the fluid;

wherein a positive pressure signature effective to trigger the change in configuration of the flow control device requires a sequence of at least two pressure changes, each pressure change comprising at least one of an increase in pressure and a decrease in pressure having a minimum rate of change of pressure, with a measured time interval between each pressure change.

* * * * *